US005610650A

United States Patent [19]

Itoh

[11] Patent Number: 5,610,650

[45] Date of Patent: Mar. 11, 1997

[54] ELECTRONIC PARTS, THERMAL HEAD, MANUFACTURING METHOD OF THE THERMAL HEAD, AND HEAT SENSITIVE RECORDING APPARATUS

[75] Inventor: Hiroshi Itoh, Hyogo, Japan

[73] Assignee: Mitsubishi Denki Kabushiki Kaisha, Tokyo, Japan

[21] Appl. No.: 165,160

[22] Filed: Dec. 10, 1993

[30] Foreign Application Priority Data

Dec. 28, 1992 [JP] Japan ..... 4-360042
Apr. 30, 1993 [JP] Japan ..... 5-124678

[51] Int. Cl.[6] ..... B41J 2/34

[52] U.S. Cl. ..... 347/210; 347/180

[58] Field of Search ..... 347/200, 201, 347/208, 209, 210, 211, 180

[56] References Cited

U.S. PATENT DOCUMENTS 4,518,971 5/1985 Endo .
4,591,877 5/1986 Shiratsuki .
4,782,202 11/1988 Sawae et al. .

FOREIGN PATENT DOCUMENTS 0053895 6/1982 European Pat. Off. .
0488806 6/1992 European Pat. Off. .
0537680 4/1993 European Pat. Off. .
2504060 10/1982 France .
51-58958 5/1976 Japan .
51-81138 7/1976 Japan .
51-115838 10/1976 Japan .
51-115839 10/1976 Japan .
57-038174 2/1982 Japan .
59-123364 7/1984 Japan .
59-123365 7/1984 Japan .
61-280953 12/1986 Japan .
5-8428 1/1993 Japan .
5-8429 1/1993 Japan .

OTHER PUBLICATIONS

H. Sawai et al., Journal of the Electrochemical Society, "A Study on the Low Energy Consumption Thermal Head Using Electroless Ni–W–P Alloy Films as Heating Resistors", vol. 137, No. 11, Nov. 1990, Manchester, N. H., pp. 3653–3660.

*Primary Examiner*—Huan H. Tran
*Attorney, Agent, or Firm*—Rothwell, Figg, Ernst & Kurz

[57] ABSTRACT

A thermal head comprising heating resistors connected in series and arranged on an edge portion of a substrate, first group switching elements respectively connected to first group electrode patterns, second group switching elements respectively connected to second group electrode patterns, and a selecting circuit for selecting one group or the other group of every other switching elements in the second group switching elements, and for selecting at least one of the first group switching elements, whereby a high quality of printing is attained without using diode array.

19 Claims, 31 Drawing Sheets

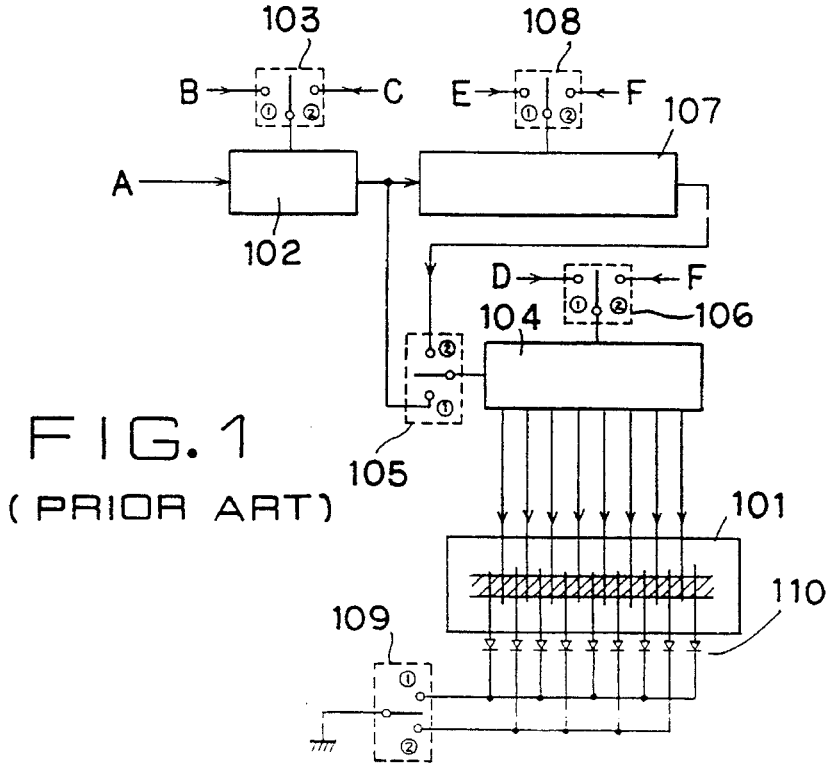
FIG. 1
(PRIOR ART)
FIG. 2
(PRIOR ART)
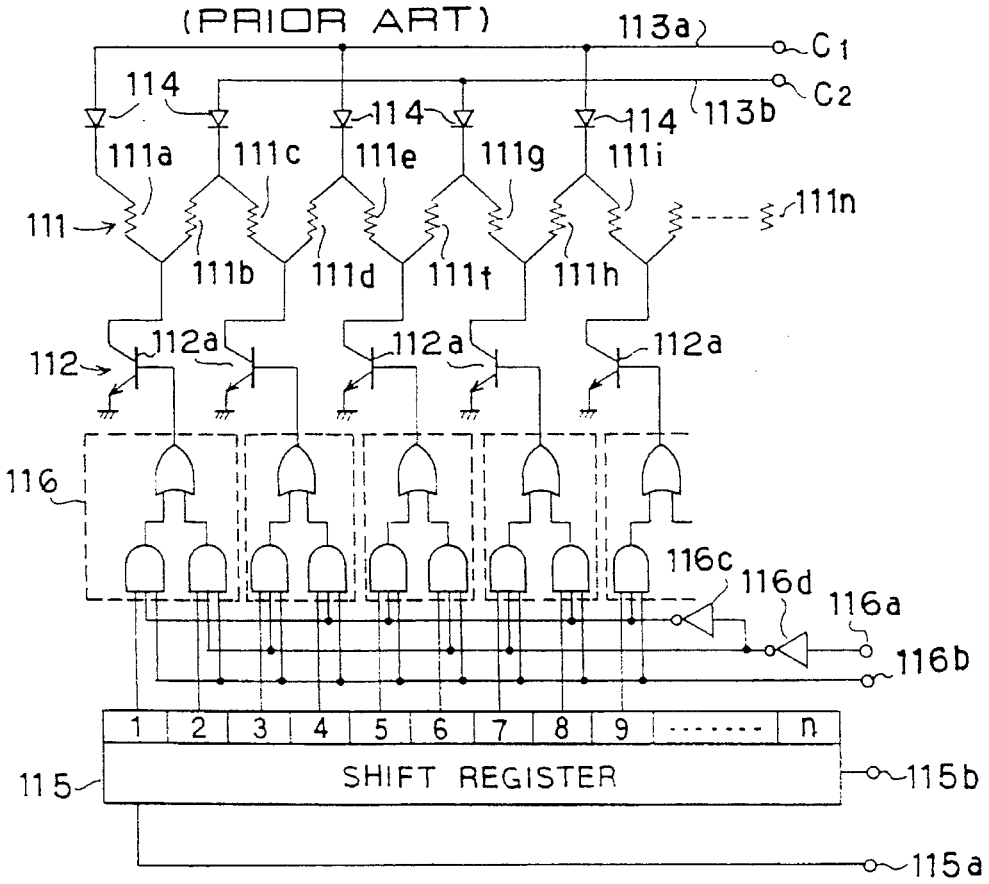

8f
R1
R2
R3
R4
R5
R6
R7
R8
R(N-1)
RN
TA1
TB1
TA2
TB2
TA3
TB(N/2)
TA(N/2+1)
(N=2M,M=1,2....)
TC
DO1
DO2
DO3
DO4
DON
L1
L2
L3
L4
L5
L6
L7
L8
LN
L(N-1)
D1
D2
D3
D4
D5
D6
D7
D8
DN
D(N-1)
DATA OUT
COM
GND
STROBE
FCON
VDD
LATCH
DATA
CLOCK

| EXPERIMENT No. | EXPERIMENT SIZE | | | | | |
|---|---|---|---|---|---|---|
| | P | L | LG | G | RP | RL |
| (1) | 63.5 μm | 25.5 μm | 0 μm | 38 μm | 0 μm | 120 μm |
| (2) | 63.5 | 15 | 5.25 | 38 | 10 | 120 |
| (3) | 63.5 | 15 | 11.75 | 25 | 10 | 120 |
| (4) | 63.5 | 15 | 16.75 | 15 | 10 | 120 |

FIG. 37
| EXPERIMENT No. | EXPERIMENT SIZE | | | | | | |
|---|---|---|---|---|---|---|---|
| | P | L | LG | G | RP | RL | RC |
| (2) | 63.5 μm | 15 | 5.25 | 38 | 10 | 120 | 0 μm |
| (5) | 63.5 | 15 | 5.25 | 38 | 10 | 120 | 10 |
| (6) | 63.5 | 15 | 5.25 | 38 | 10 | 120 | 20 |
| (7) | 63.5 | 15 | 5.25 | 38 | 10 | 120 | 30 |
| (8) | 63.5 | 15 | 5.25 | 38 | 10 | 120 | 40 |
FIG. 38
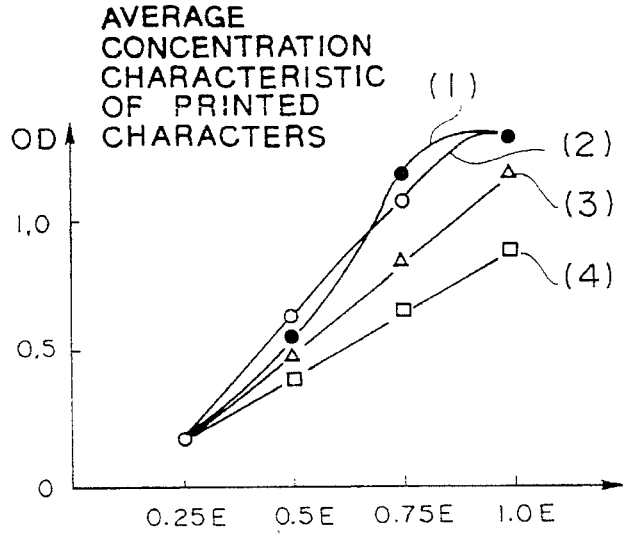
FIG. 39
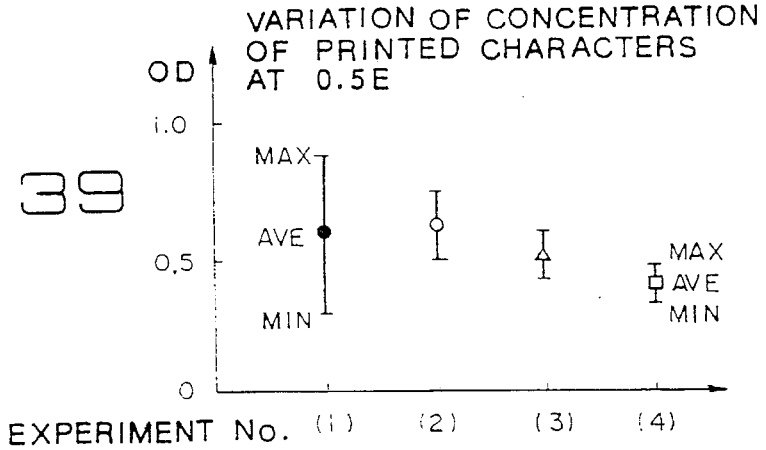

FIG. 44
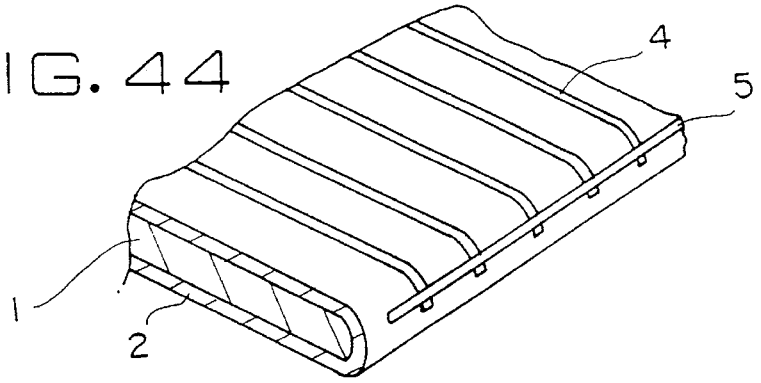
FIG. 45
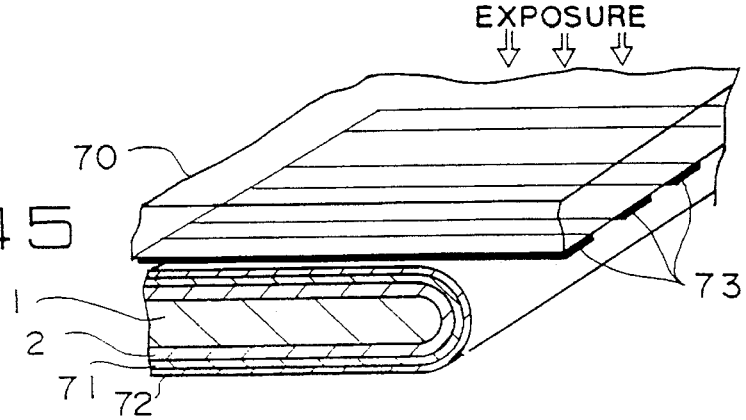
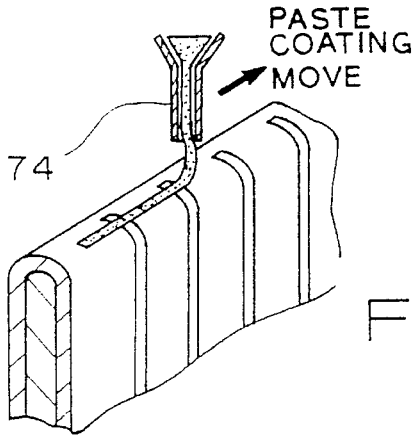
FIG. 46
FIG. 47
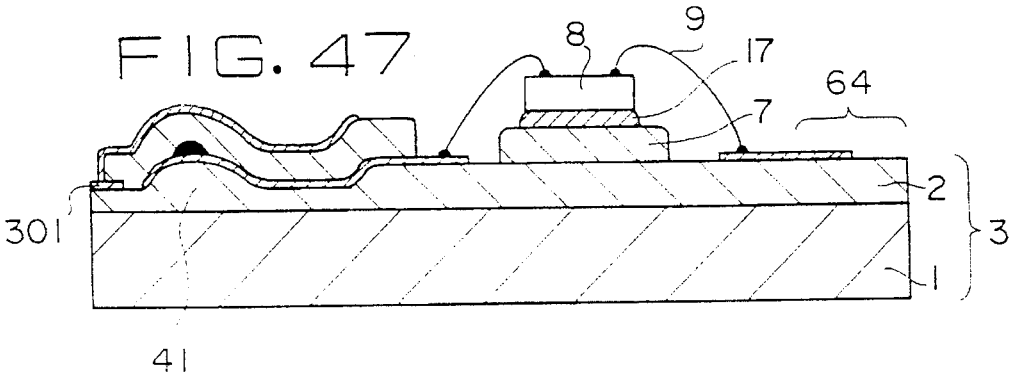

ELECTRONIC PARTS, THERMAL HEAD, MANUFACTURING METHOD OF THE THERMAL HEAD, AND HEAT SENSITIVE RECORDING APPARATUS

BACKGROUND OF THE INVENTION

1. Field of the Invention

The present invention relates to an electronic driving circuit for driving passive elements such as heating resistors, a thermal head provided with heating resistors, a manufacturing method of the thermal head, and heat sensitive recording apparatus using the thermal head.

2. Description of the Prior Art

FIG. 1 is a circuit diagram showing a conventional thermal head of a thick film alternately reading type system disclosed in, for example, a Japanese Patent Publication (Kokai) No. 51-81137. In the figure, 101 is a recording head, 102 is a line memory for recording information signal (represented by A) quantized in time for one scanning line, 103 is a switch for switching a driving signal (B or C) for the line memory 102, 104 is a memory represented by a shift register of a serial input and parallel output type which stores one half of the one scanning line recording information signals and outputs these signals in parallel, and which is connected through not-shown switching elements (represented by transistors) to one-side leads of the recording head 101. Also, 105 is a switch for selecting an input signal to the memory 104, 106 is a switch for switching a driving clock signal (D or F) for the memory 104, 107 is a memory for recording another half of the recording information signals for one scanning line, 108 is a switch for switching a driving clock signal (E or F) for the memory 107, 109 is a switch for selecting a common terminal from common terminals which are connected to an odd group and an even group of the other-side leads, in the sequence of the arrangement of the recording head a and 110 denotes inverse current preventing elements represented by a semiconductor diode array.

Such a thermal head is widely used in the field of facsimile machines, printers, plotters and so forth, because of the simple printing system.

Apart from the above, as conventional thick film thermal heads, there are those disclosed in Japanese Patent Publication (Kokai) No. 51-58958, Japanese Patent Publication (Kokai) No. 51-81138, Japanese Patent Publication (Kokai) No. 51-81138, Japanese Patent Publication (Kokai) No. 51-115838, and Japanese Patent Publication (Kokai) No. 51-115839.

In the thermal head of the thick film alternately reading type shown in FIG. 1, heating resistors (not shown) of the reading head 101 are driven by a circuit formed by the inverse current preventing circuit 110 formed by the diode array a the line memory 102, the memory 104, the memory 107 driven the switching elements which are driven by the recording information. Therefore, when at least one line is to be printed, it is necessary to drive the heating resistors by each half of the recording information signals, namely, by switching the line memory 102 and the memory 107 (which are buffer memories). The data transfers for printing one line of the recording information are two. This is because the diode array 110 is separated into two groups, so that a switching by the switch 109 is necessary. Here, the current to be conducted through one diode is relatively large in comparison with the current through one transistor, so that, when plural diodes are driven at the same time, the switching requires a large current. Accordingly, if the switching speed is increased, the diode array 110 or the switch 109 (formed by, for example transistors) will be broken due to the generation of spike noises caused by the large current switching. Therefore, it is impossible to effect the high speed switching. In conclusion, a current to be passed through only one diode can be switched at a high speed, however, the elements which can realize the switch 109 must always be limited to be able to switch a large current at a high speed.

Further, the printing data for one line must be separated and stored into the buffer memories 102 and 107 and must be combined again to form the driving information. To this end, there is known a thermal head disclosed in the above-mentioned Japanese Patent Publication (Kokai) No. 59-123364 and the Japanese Patent Publication (Kokai) No. 59-123365.

FIG. 2 is a circuit diagram showing a conventional thermal head disclosed in, for example, Japanese Patent Publication (Kokai) No. 59-123365. In the figure, 111 is a heating element group consisting of n heating elements 111*a* to 111*n* which are arranged adjacent to each other, 112 is a transistor array consisting of n/2 transistors 112*a* which are heating element driving buffer elements, each of the transistors 112*a* being connected to one pair of the adjacent two heating elements in the heating elements 111*a* to 111*n* in the heating element group, and 113*a* and 113*b* are first and second common electrodes to which voltages $V_1$ and $V_2$ are applied at different times, the first heating element 111*a* of the above-mentioned heating element group 111 being connected to the first common electrode 113*a*, the adjacent two of the second to (n−1)-th heating elements 111*b* to 111n−1 being sequentially connected to the second or the first electrode 113*a* or 113*b*, and the n-th heating element 111*n* being solely connected to the second or the first common electrode 113*a* or 113*b*. 114 is an inverse current preventing diode, 115 is an n-bit shift register for holding the printing data to the heating element group 111, 115*a* and 115*b* are clock input terminals and data input to the shift register 115, 116 is a multiplexer for selecting one output from two outputs in the parallel outputs of the shift register 115 to switch a transistor 112*a*, 116*a* is a terminal for receiving a selecting signal for selecting one or the other group of adjacent two AND gates in the multiplexer 116, and 116*b* is a terminal for receiving a strobe signal for determining the driving period of the heating resistors 111. To the terminal 116*b*, a driving signal "H" is applied in the driving period, and a signal "L" is applied when all of the heating resistors are not to be driven. 116*c* and 116*d* are inverters.

As shown in FIG. 2, the n-bit printing data for one line are stored in the shift register 115, and the heating element driving data can be easily obtained by the multiplexer 116 so that the data division and reconstruction, which were necessary in the prior art shown in FIG. 1, are not necessary in the prior art of FIG. 2.

In FIG. 2, however, there are problems as follows.

First, since the diodes in the diode array 114 are driven by switching the signals applied to the terminals C1 and C2 by using transistor switches (not shown), and since a current to be conducted through each diode is relatively large, a large current is passed through the switching transistors when the switching is carried out. Therefore, a high speed switching can not be effected.

Second, the transistor array 112, the shift register 115, and the multiplexer 116 are formed as an integrated circuit in an IC chip. Accordingly, to realize the thermal head shown in FIG. 2, as shown in FIG. 3A which is a plan view of the thermal head including the IC chip, the heating resistors 111 must be arranged on the center of a substrate 311, the diode array 114 must be arranged on the one side of the substrate 311, and the IC chip 312 including the shift register 115, the multiplexer 116, and the transistor array 112 must be arranged at the other side of the substrate 311 opposite to the diode array 114 with respect to the heating resistors 111.

As a result, either the diode array side or the IC chip side becomes the output portion for the recording paper 313 which is in contact with the heating resistors so that the image cannot be seen immediately after printing FIG. 3B shows a side view of the thermal head shown in FIG. 3A. In FIG. 3B, 111 is the heating resistor, 311 is the substrate of the thermal head, 313 is a recording paper, and 314 is a platen roller for carrying the recording paper 313. As can be seen from FIG. 3B, users can see the printed paper only after the portion of the recording paper 313 printed by the heating resistors 111 passes the portion of the IC chip 312 or the portion of the diode array 114, depending on the direction of the paper through the thermal head printer. Accordingly, there are disadvantages in that it takes a long time to adjust the position of the recording paper 313 and, if the positioning of the recording paper is wrong, a considerable amount of the recording paper 313 must be discarded before repositioning it.

On the other hand, with respect to the shape of a printing dot of these known thick film alternately reading type thermal heads shown in FIG. 1 and FIG. 2, the shape of the printing dots for one horizontal line is formed by a pair of two dots as shown in FIG. 9A described later, however, since the switching speed of the switch 109 in FIG. 1 or the switching speed of the signals applied to the terminals C1 and C2 can not be high, the dot width in the sub scan direction is so long that the level of the quality of the picture does not allow for printing of graphs and so forth. To prevent this, it may be possible to drive the switch 109 in FIG. 1 or to switch the signals applied to the terminals C1 and C2 in FIG. 2 and to transfer data many times during one line printing so that, as shown in FIG. 9B, it may be anticipated that the width of the printed dots may become within the allowed level. However, to realize this, since the switch 109 or the signal applied to the terminals C1 and C2 is switched with a large current, it is difficult to realize the dot shape shown in FIG. 9B when the printing speed is high. Also, since the printing data transfer is effected so frequently, it is difficult to realize the dot shape shown in FIG. 9B. Accordingly, by the prior art thermal head shown in FIG. 1 or FIG. 2, the shape of the printing dots is that shown in FIG. 9A when the printing period is around 1.25 ms.

As other conventional examples, Japanese Patent Publication (Kokai) No. 5-8428 and Japanese Patent Publication (Kokai) NO. 5-8429 are known, however, these are the same as above in the points that each of these also uses a diode array so that the switching is effected with a large current.

In conclusion, since the conventional thermal heads are constructed as above, there were problems in that the high speed switching element driving with a large current is difficult, the quality of the picture is not good, and the picture immediately after printing can not be seen.

The above-described problems in the prior art reside not only thermal heads but also other electronic parts having the similar construction as the thermal head.

SUMMARY OF THE INVENTION

In view of the foregoing, it is an object of the present invention to provide an electronic parts which does not need high-speed switching elements and a diode array.

It is another object of the present invention to provide a thermal head which does not need a high-speed switching element and a diode array.

It is a still another object of the present invention to provide a thermal head which can improve the quality of the printed image.

It is a further object of the present invention to provide a thermal head by which an image can be seen immediately after printing.

It is a further object of the present invention to provide a thermal head in which a pattern connection is easy and the power loss consumed by the voltage source pattern and the grounding pattern is decreased.

It is a still further object of the present invention to provide a manufacturing method of a thermal head in which heating resistors can be formed at the edge surface of a substrate so that an image immediately after printing can be immediately seen.

It is a further object of the present invention to provide a heat sensitive recording apparatus which can provide a printed image of an improved quality and by which a printed image immediately after printing can be immediately seen.

According to the first aspect of the present invention, for achieving the above-mentioned objects, there is provided an electronic driving circuit comprising a plurality of passive elements connected in series and arranged on an edge portion of a substrate, first group switching elements respectively connected to first group electrode patterns, second group switching elements respectively connected to second group electrode patterns, and a selecting circuit for selecting one group or the other group of every other switching element in the second group switching elements, and for selecting at least one of the first group switching elements. The selected switching elements are driven substantially simultaneously whereby at least one of the passive elements corresponding to the selected switching elements are driven.

As stated above, in the electronic driving circuit according to the first aspect of the present invention, since the passive elements are arranged on an edge portion of a substrate, an electronic effect derived from the passive elements can be immediately seen by users.

In addition, since the selecting circuit selects one group or the other group of the second group switching elements, and substantially simultaneously selects at least one of the first group switching elements, a diode array is not necessary so that the switching can be effected with a small current. Therefore, the switching speed can be increased.

According to the second aspect of the present invention, the above mentioned electronic circuit is part of a thermal head, in which the above-mentioned passive elements are heating resistors.

As stated above, in the thermal head according to the second aspect of the present invention, since the heating resistors are arranged on an edge portion of a substrate, a printed image immediately after printed by the heating resistors can be immediately seen by users.

In addition, since the selecting circuit selects one group or the other group of the second group switching elements, and substantially simultaneously selects at least one of the first group of switching elements, a diode array is not necessary so that the switching can be effected with a small current. Therefore, the switching speed can be increased.

According to the third aspect of the present invention, the first group and said second group of switching elements and said selecting circuit are formed on an IC chip. The IC chip further comprises a grounding pattern arranged around the central portion in the direction of the short side of said IC chip, a voltage source pattern arranged around the edge portion in the direction of the short side of said IC chip, and a plurality of pads connected to said grounding pattern and said voltage source pattern, said pads being located at the edge portion along the longitudinal direction of one side of said IC chip, said grounding pattern and said voltage source pattern being connected to external members through said pads.

As stated above, according to the third aspect of the present invention, since the grounding pattern is arranged around the central portion of the IC chip and the voltage source pattern is arranged around the edge portion of the IC chip, the pads can be located along the one longitudinal side of the IC chip so that the external members can be connected through the pads to the voltage source pattern and to the grounding pattern with the shortest distance so that the power loss can be decreased.

According to the fourth aspect of the present invention, there is provided a manufacturing method of a thermal head comprising the steps of adhering a conduction film to the upper surface of a substrate up to its edge surface or near the edge surface, adhering a photo-sensitive resist to the upper surface of the substrate and up to the edge surface, then exposing light from said upper surface of the substrate through a pattern mask, forming a plurality of electrodes from said upper surface of the substrate to the edge surface of the substrate by etching of photolithography, and forming heating resistors between the electrodes.

As stated above, according to the fourth aspect of the present invention, since the heating resistors are formed around the end surface of the substrate, the manufacturing method of the thermal head by which an image can be immediately seen after printing can be obtained.

According to the fifth aspect of the present invention, there is provided a heat sensitive recording apparatus comprising the above-mentioned one of the thermal heads and a platen roller for carrying a recording paper through said thermal head.

As stated above, according to the fifth aspect of the present invention, since the above-mentioned thermal head is employed, a heat sensitive recording apparatus which can provide a printed image of an improved quality and which can make it possible to see the printed image immediately after printing.

The above and further objects and novel features of the invention will more fully appear from the following detailed description when the same is read in connection with the accompanying drawings. It is to be expressly understood, however, that the drawings are for the purpose of illustration only and are not intended as a definition of the limits of the invention.

BRIEF DESCRIPTION OF THE DRAWINGS

FIG. 1 is a circuit diagram showing a conventional thermal head;

FIG. 2 is a circuit diagram showing another conventional thermal head;

Figure 29:
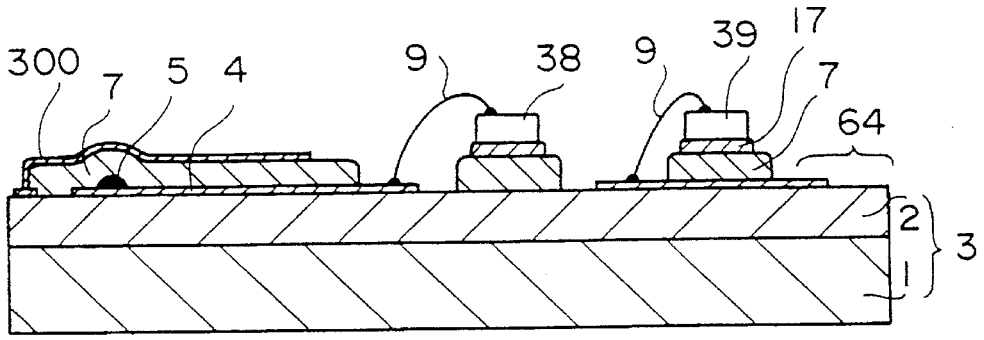
Figure 30:
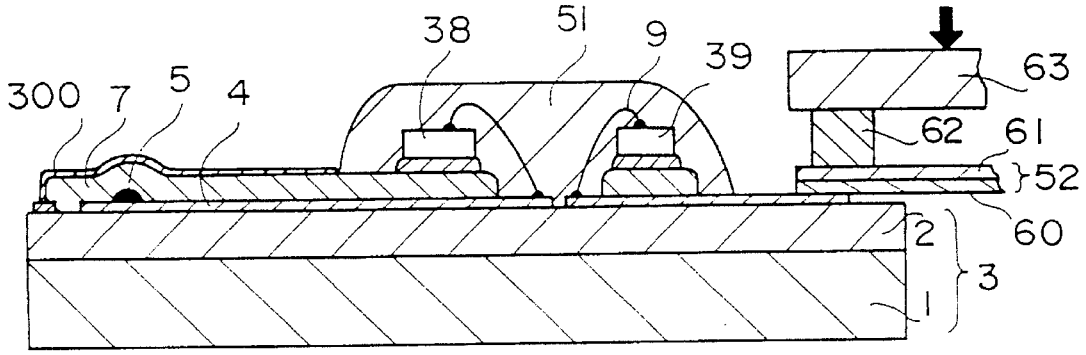
Figure 31:
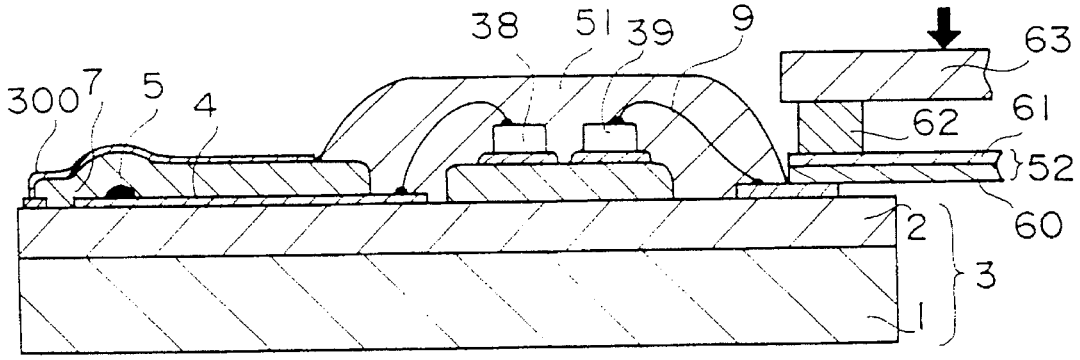
Figure 32:
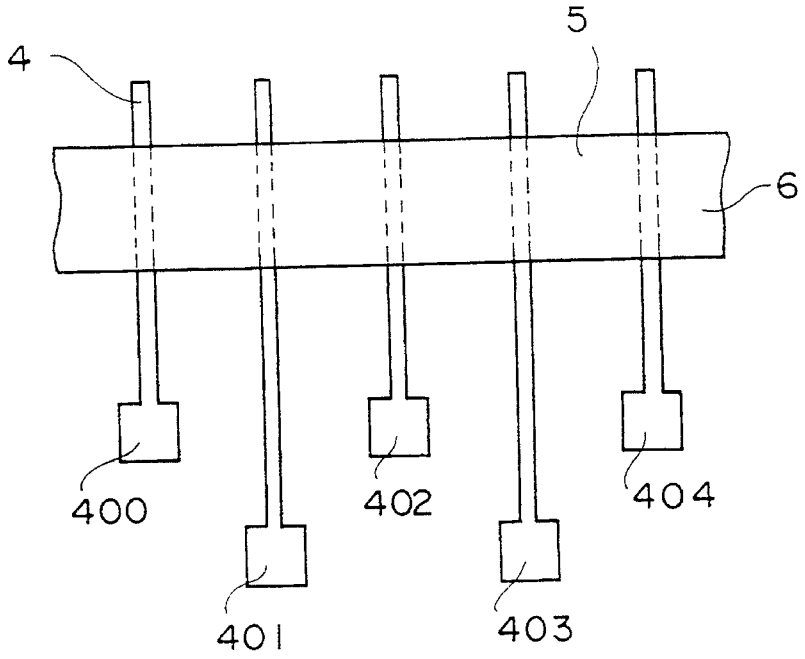
Figure 33:
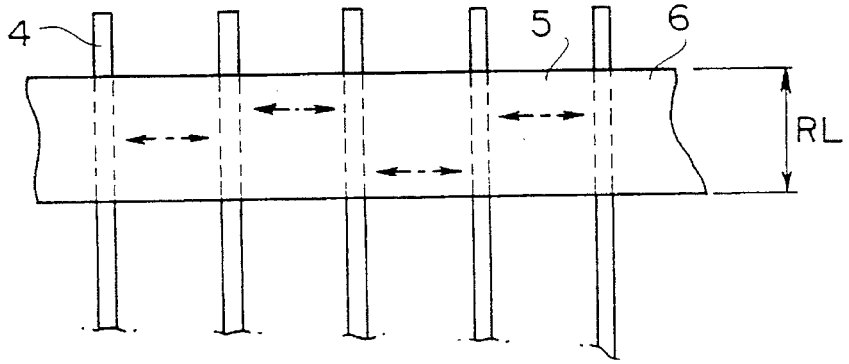
Figure 34:
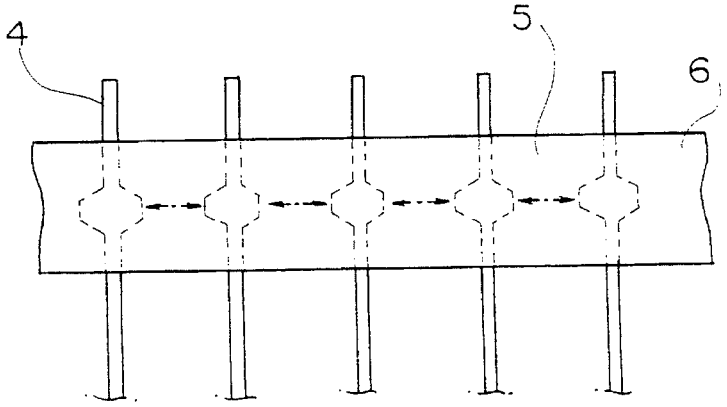
Figures 35, 36:
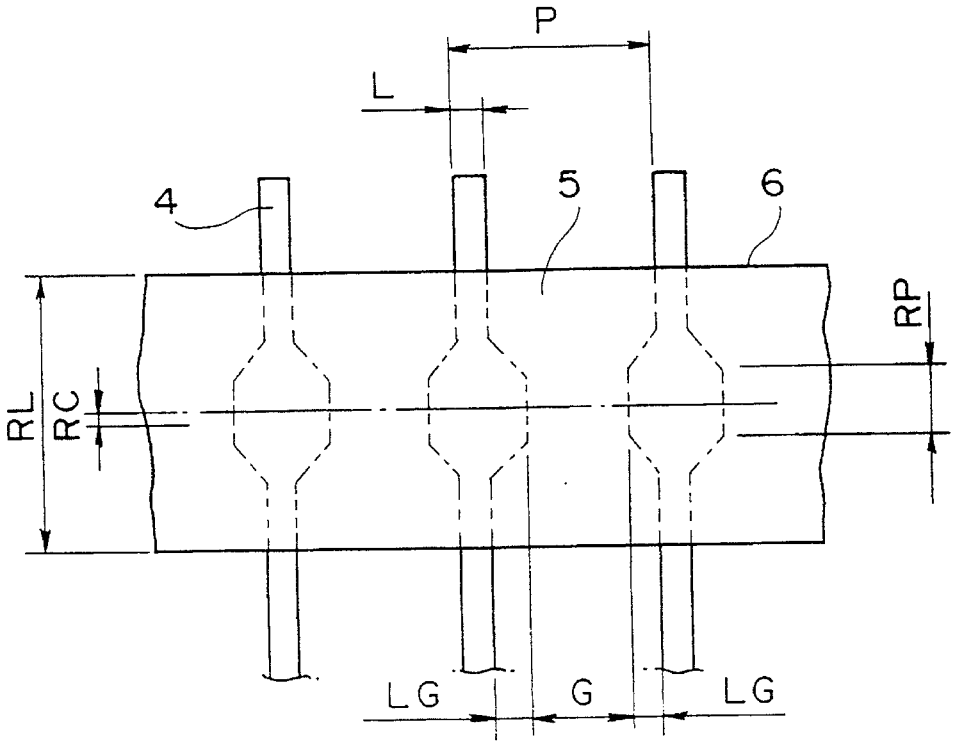
Figure 40:
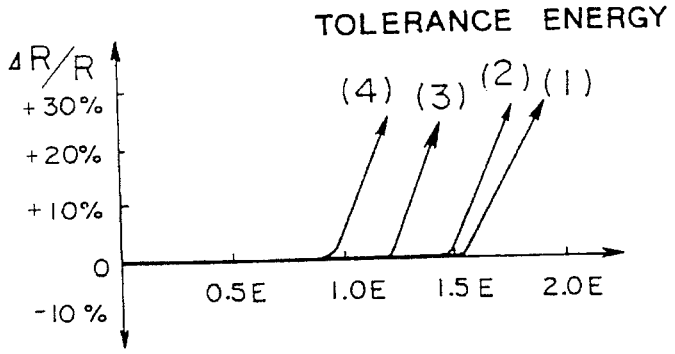
Figure 41:
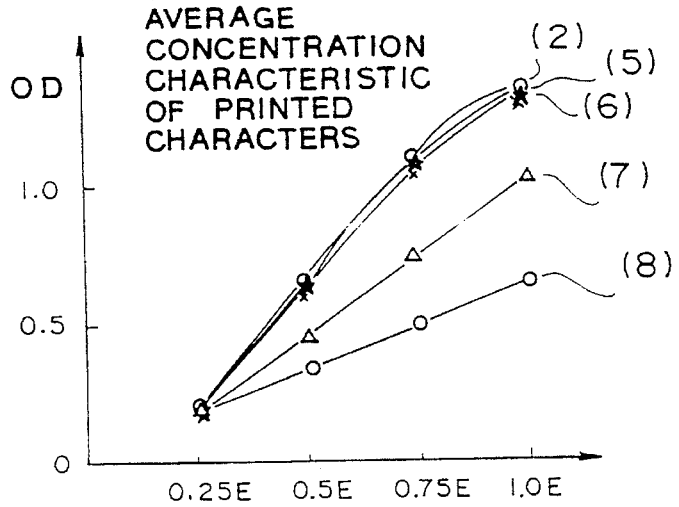
Figure 42:
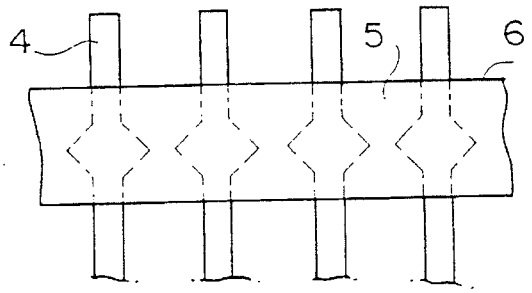

24, according to still another embodiment of the present invention;

FIG. 29 is a cross-sectional view of a thermal head substrate according to still another embodiment of the present invention;

FIG. 30 is a cross-sectional view of a thermal head substrate according to still another embodiment of the present invention;

FIG. 31 is a cross-sectional view of a thermal head substrate compared to the thermal head substrate shown in FIG. 30;

FIG. 32 is a plan view showing an electrode pattern in thermal head according to still another embodiment of the present invention;

FIG. 33 is a plan view showing a part of the electrode pattern shown in FIG. 32;

FIG. 34 is a plan view showing another shape of the electrode pattern according to still another embodiment of the present invention;

FIG. 35 is an expanded plan view of the electrode pattern shown in FIG. 34;

FIG. 36 is a data diagram showing experimental sizes of the thermal head according to an embodiment of the present invention;

FIG. 37 is a data diagram showing experimental sizes of the thermal head according to an embodiment of the present invention;

FIG. 38 is a characteristic diagram of average concentrations of printed characters by the thermal head according to an embodiment of the present invention;

FIG. 39 is a diagram showing variations of the concentrations of the printed characters by the thermal head according to an embodiment of the present invention;

FIG. 40 is a diagram showing the characteristic of tolerance energy of the thermal head according to an embodiment of the present invention;

FIG. 41 is a characteristic diagram of average concentrations of printed characters by the thermal head according to an embodiment of the present invention;

FIG. 42 is a plan view showing another shape of an electrode pattern in a thermal head according to still another embodiment of the present invention;2

Figure 43:
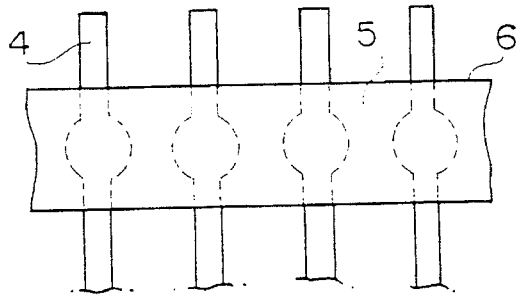
Figure 48:
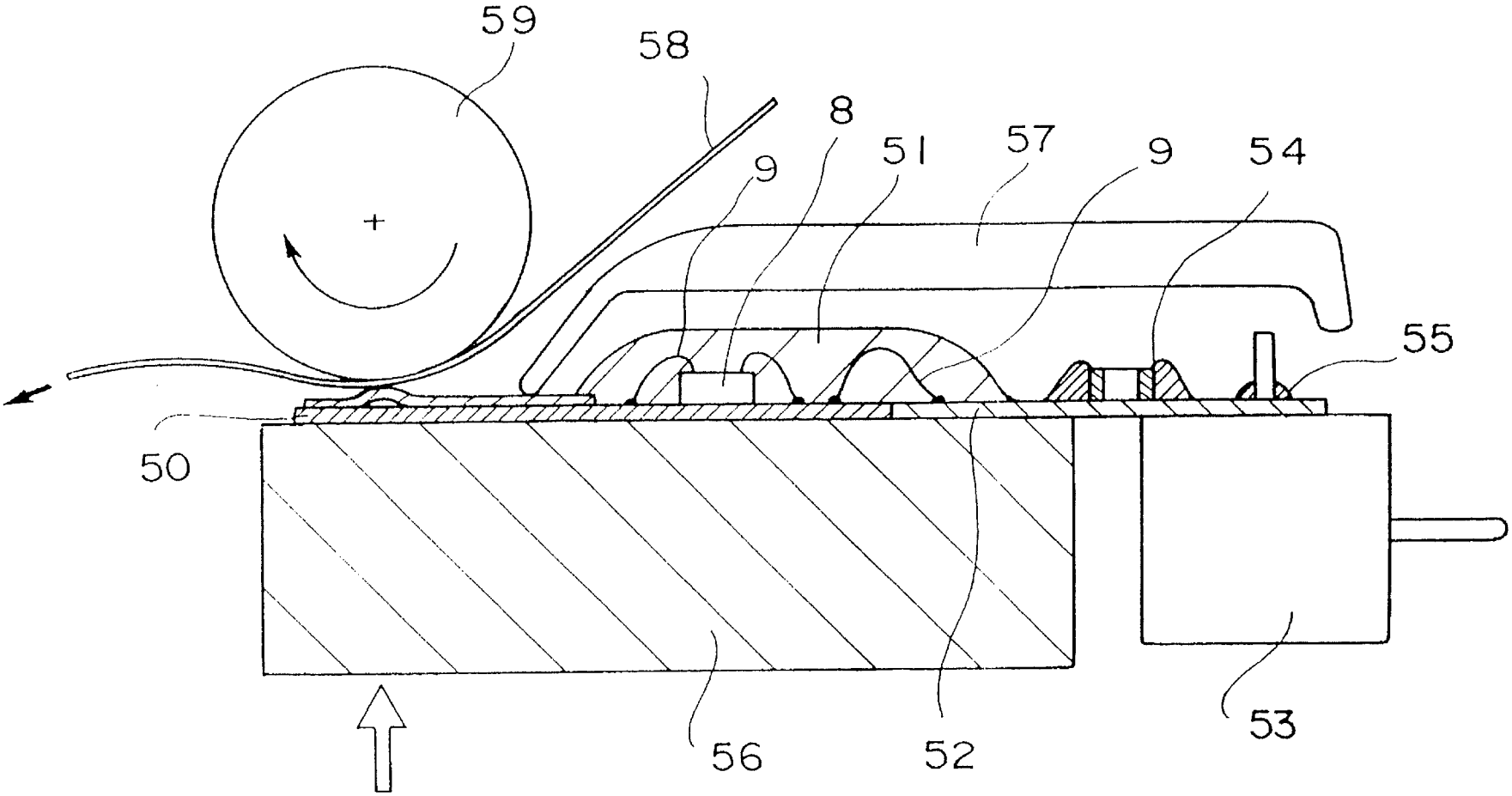
Figure 49:
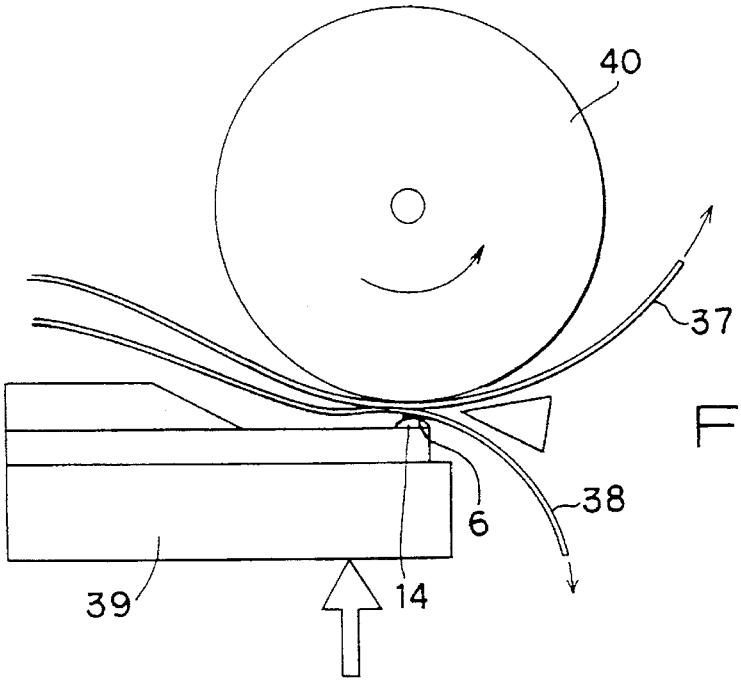

FIG. 43 is a plan view showing another shape of an electrode pattern in a thermal head according to still another embodiment of the present invention;

FIG. 44 is a perspective view of a thermal head substrate according to another embodiment of the present invention;

FIG. 45 is a perspective view showing a manufacturing process of the thermal head of FIG. 44;

FIG. 46 is a perspective view showing a process for forming the heating resistor on the thermal head substrate after the manufacturing process of FIG. 45;

FIG. 47 is a cross-sectional view of a thermal head substrate according to another embodiment of the present invention;

FIG. 48 is a front view of a heat sensitive recording apparatus to which the thermal head of the present invention is applied;

FIG. 49 is a front view of a heat transfer recording apparatus to which the thermal head of the present invention is applied; and FIG. 50 is an explanation diagram of a thermal head substrate according to still another embodiment of the present invention.

DESCRIPTION OF THE PREFERRED EMBODIMENTS

Embodiment 1

Figure 3A:
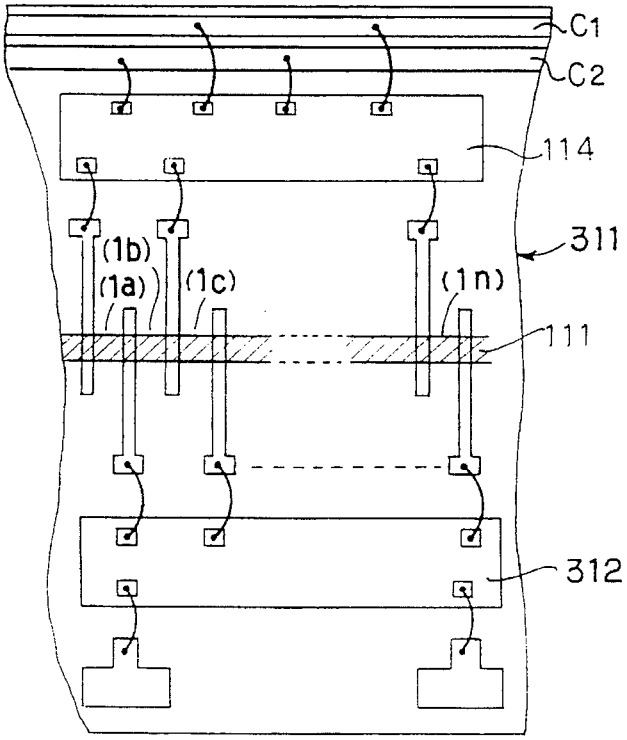
FIG. 3A is a plan view of a part of the conventional thermal head shown in FIG. 2.
Figure 3B:
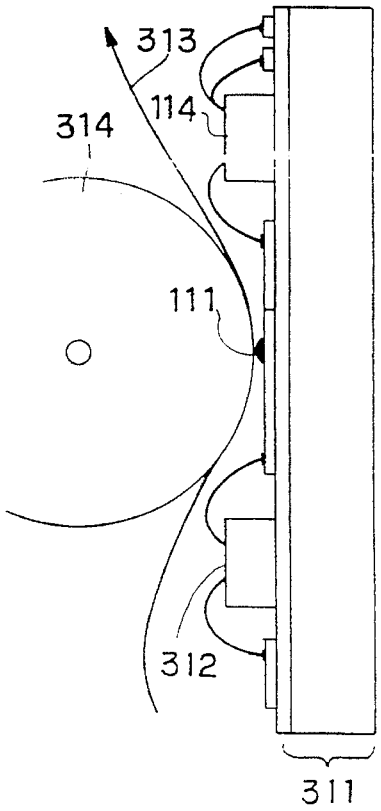
FIG. 3B is a side view of the conventional thermal head shown in FIG. 3A, showing a recording paper carrying state.
Figure 4B:
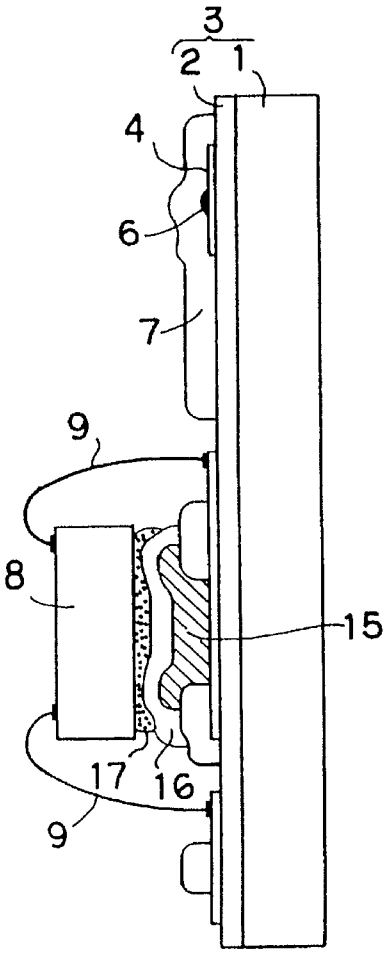
FIG. 4A and FIG. 4B are a plan view and a cross-sectional view showing a thermal head substrate according to an embodiment of the present invention.
Figure 4A:
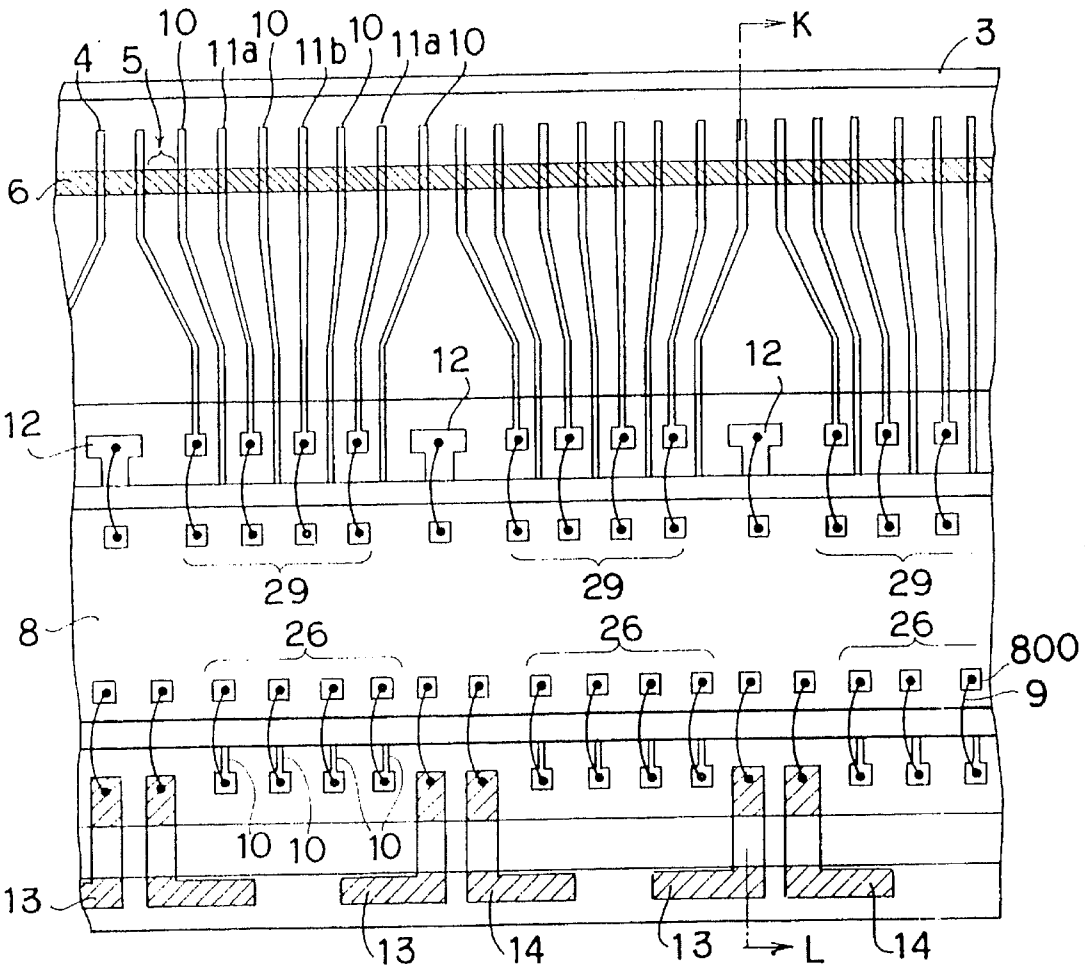

In the following, an embodiment of the present invention will be described with reference to the drawings. FIG. 4A and FIG. 4B are a plan view and a cross-sectional view showing electronic components such as a thermal head according to an embodiment of the present invention. In FIGS. 4A and 4B, 1 is, for example, an alumina-ceramic substrate with a purity of about 96%, 2 is a glaze layer which covers the alumina-ceramic substrate 1 and is formed to have a thickness of several ten microns in order to have a smooth characteristic and a heat characteristic of passive elements such as heating resistors to be arbitral.

In the following description, as the electronic circuit, the thermal head including the heating resistors will be described. 3 is a substrate including the alumina-ceramic substrate 1 and the glaze layer 2.4 is an electrode pattern, 5 is the passive elements such as heating resistors each of which is formed between the electrode patterns 4. In a thick film thermal head, the heating resistors 5 are formed by, for example, coating a strip-shaped resistor 6 on the electrode patterns 4.7 is a protection film consisting of, for example, glass which covers the heating resistors 5 and so forth, and which may also be an insulating film between layers. 8 is an IC chip, 9 represents gold wires for connecting the electrode patterns 4 and conducting patterns connected to various signal terminals on the substrate 1 to pads on the IC chip 8, 10 represents current flowing-out electrode patterns in the electrode patterns 4, 11*a* and 11*b* represent current flowing-in electrode patterns, 12 represents ground terminals, 13 represents common electrode terminals, 14 represents various signal terminals, 15 represents a conductor for commonly connecting the ground terminals 12, 16 is an insulating layer covering the conductor 15, and 17 represents adhesive for fixing the IC chip 8.

Figure 5B:
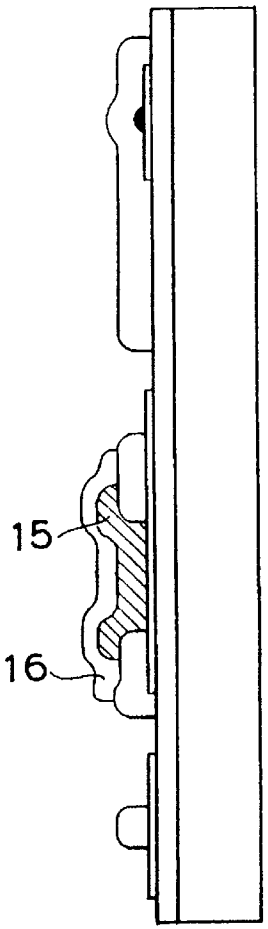
FIG. 5A and FIG. 5B are plan view and a cross-sectional view of the thermal head in which the IC chip and the gold wires in FIG. 4A and FIG. 4B are omitted.
Figure 5A:
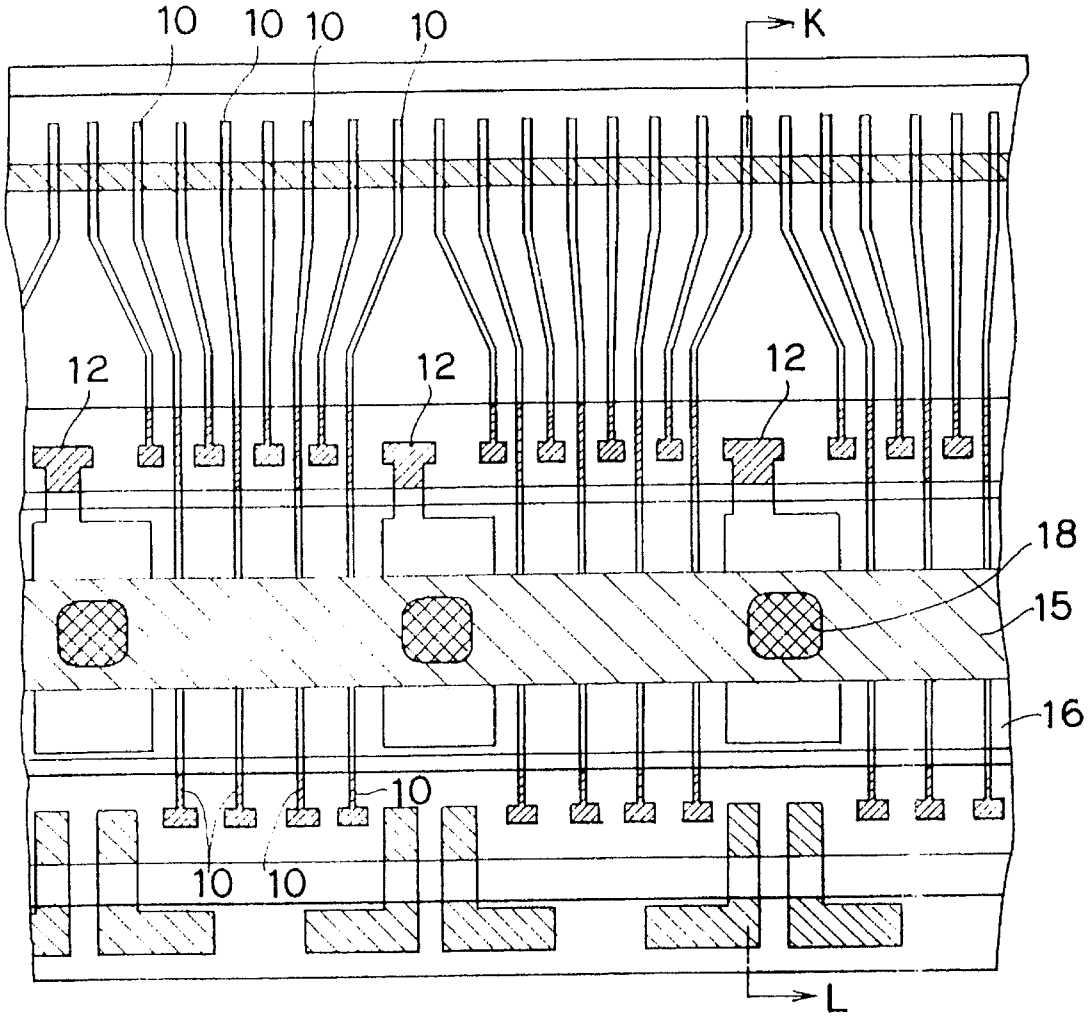
Figure 18:
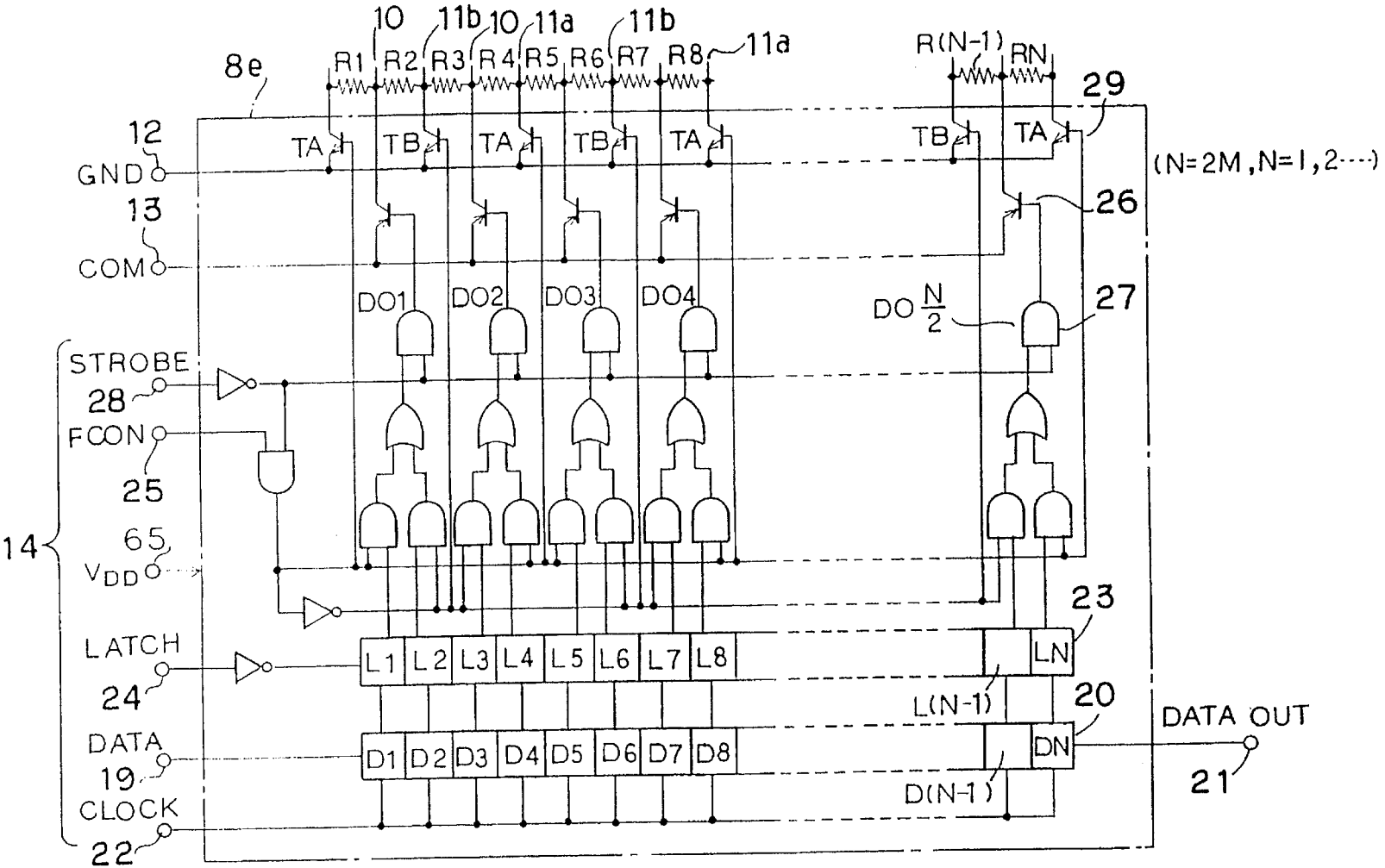
FIG. 18 is a circuit diagram of a thermal head according to still another embodiment of the present invention.

FIG. 5A and FIG. 5B are plan view and a cross sectional view of the thermal head in which the IC chip 8 and the gold wires 9 are omitted from FIGS. 4A and 4B. In FIGS. 5A and 5B, 18 represents connecting points between the ground terminals 12 and the conductor 15.

Figure 6:
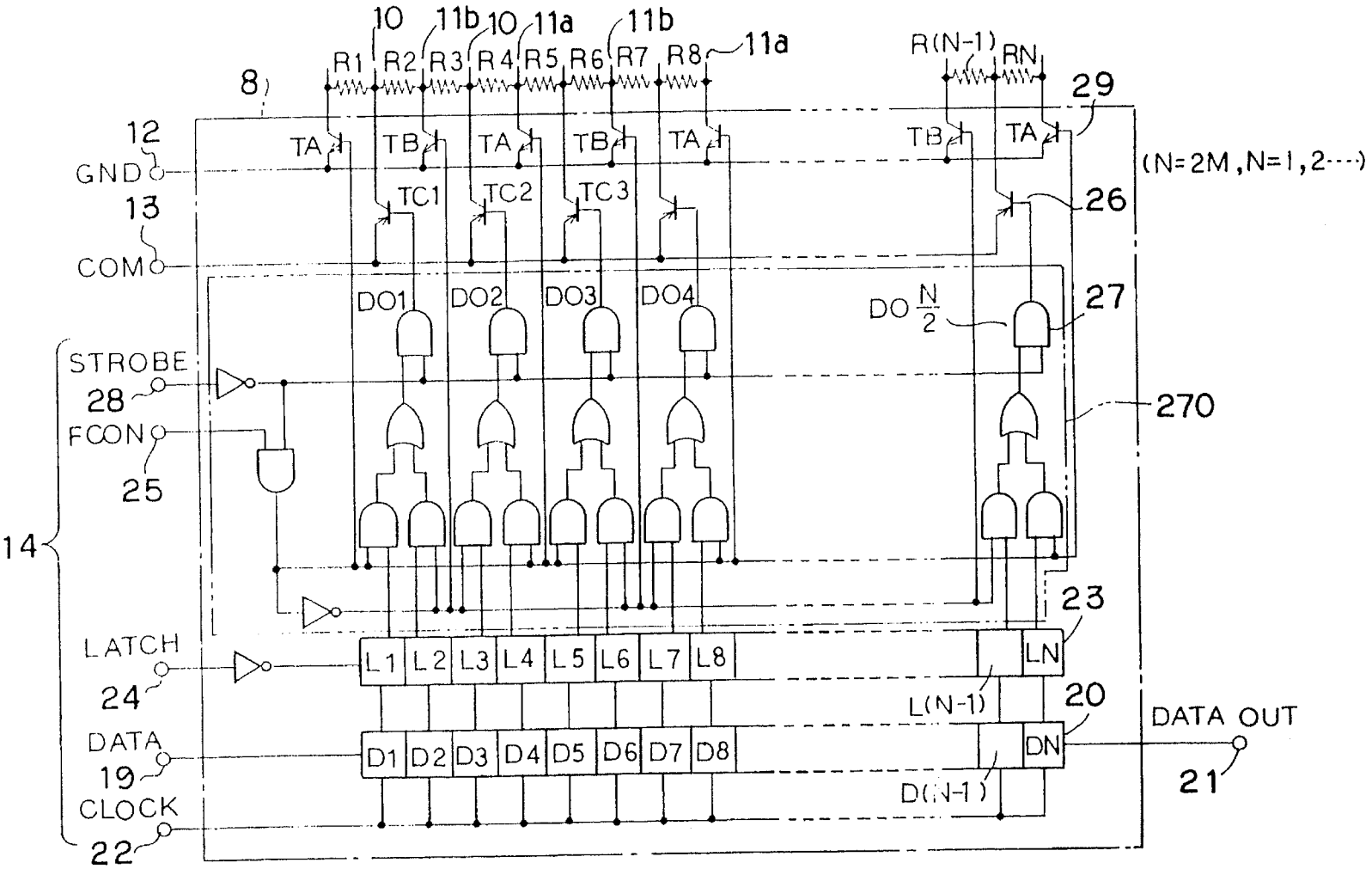
FIG. 6 is a circuit diagram showing the thermal head according to an embodiment of the present invention.

FIG. 6 is a circuit diagram of the IC chip 8 in the thermal head shown in FIGS. 4A and 4B. In FIG. 6, 19 is a driving-data input terminal (hereinafter referred to as DATA), 20 is an N-bit shift register, 21 is a driving-data output terminal, 22 is a synchronous-signal input terminal for the shift register 20 (hereinafter referred to as a CLOCK), 23 is a latch circuit (storage element) of an N-bit storage circuit connected to the N-bit shift register, 24 is a data-transfer control terminal (hereinafter referred to as *LATCH(here, * represents a logical NOT)) for transferring data in the shift register to the latch circuit 23, 25 is a selecting signal input terminal (hereinafter referred to as FCON) for selecting one half of the N-bit data from the latch circuit 23, and 26 represents first group switching elements which are selectively driven by a selecting circuit 27. 28 is a switching element driving-time determining signal terminal (hereinafter referred to as *STROBE), and 29 represents second group switching elements which are divided into two groups TA and TB alternately connected to the second group electrode patterns 11*a* and 11*b* respectively. In the switching elements 29, TA and TB are not simultaneously driven but are driven alternatively in accordance with the signal logic states of the *STROBE 28 and the FCON 25. Note that a power supply and a ground terminal for the IC chip itself are omitted.

From the above description with reference to FIG. 4A, 4B, 5A, 5B, and FIG. 6, it will be apparent that the thermal head according to the embodiment 1 comprises a plurality of heating resistors 5 connected in series and arranged on an edge portion of a substrate 3, a plurality of electrode patterns 10, 11*a*, and 11*b* arranged on the substrate 3 in such a way that a heating resistor is connected across each adjacent electrode pattern. The electrode patterns are grouped into first group electrode patterns 10 and second group electrode patterns 11*a* and 11*b*. In every two adjacent of the electrode patterns, one is of the first group electrode patterns 10 and the other is of the second group electrode patterns 11*a* or 11*b*. The thermal head further comprises first group switching elements 26 respectively connected to the first group electrode patterns 10, second group switching elements 29 respectively connected to the second group electrode patterns 11*a* or 11*b*, and a selecting circuit 270, connected to the first group switching elements 26 and the second group switching elements 29, for selecting, in response to selecting data, one group TA or the other group TB of switching elements in the second group switching elements 29, and for selecting at least one of the first group switching elements 26. The selected switching elements are driven substantially simultaneously. Thus, at least one of the heating resistors corresponding to the selected switching elements is driven.

The first group electrode patterns 10 and the second group electrode patterns 11*a* and 11*b* are alternately arranged on the substrate 3 in such a way that adjacent two of the first group electrodes 10 and the second group electrodes 11*a* and 11*b* are connected across one of the heating resistors 5. Each of the first group switching elements 26 is, for example, a pnp transistor having an input terminal (emitter) connected to a power supply terminal COM, an output terminal (collector) connected to one of the first group electrode patterns 10, and a control terminal (base). Each of the second group switching elements 29 is, for example, an npn transistor having an input terminal (collector) connected to one of the second group electrode patterns 11*a* or 11*b*, an output terminal (emitter) connected to a grounding terminal GND, and a control terminal (base). The selecting circuit 270 is connected to the control terminal of each of the first group switching elements 26 and the control terminal of each of the second group switching elements 29, for selecting, in response to the selecting data, either one of the two groups TA and TB each including every other switching elements in the second group switching elements 29, and for selecting at least one of the first group switching elements 26.

The thermal head further comprises the shift register 20, for storing a part of the selecting data for selecting at least one of the heating resistors 5 to be driven, the storage elements 23 for latching the data output from the shift register 20, and a selecting signal input terminal 25, connected to the control terminal of each of the first group switching elements 26 and the control terminal 25 of the second group switching elements 29, for receiving a selecting signal FCON for selecting one group TA or the other group TB of the switching elements in every other second group switching elements 29.

The selecting circuit 270 selects at least one of adjacent two of the first group switching elements 26. The adjacent two are a selecting unit. The selected first group switching elements 26 is adjacent to one of the second group switching elements 29 in the selected group TA or TB.

The first group switching elements 26, the second group switching elements 29, the selecting circuit 270, the shift register 20, and the storage elements 23 are formed on an IC chip.

The thermal head further comprises a driving data input terminal 22, connected to the shift register 20, for receiving driving data DATA for driving the heating resistors 5, and a synchronizing signal input terminal 19, connected to the shift register 20, for receiving a synchronizing signal CLOCK. The driving data DATA is input into the shift register 20 in response to the synchronizing signal CLOCK. The thermal head further comprises a data transfer control terminal 24, connected to the storage elements 23, for receiving a data transfer control signal LATCH to transfer the driving data D1 to DN from the shift register 20 to the storage elements 23, and a driving time determining signal input terminal 28, connected to the selecting circuit 270, for receiving a driving time determining signal STROBE for determining the driving time of the selected one or more of the first group switching elements 26 and the selected group TA or TB in the second group switching elements 29. The selecting signal FCON and the driving time determining signal STROBE form the selecting data. The selecting circuit 270 has a logic circuit for determining the switching elements to be driven and the driving time thereof based on a logic of the driving data DATA, the selecting signal FCON, and the driving time determining signal STROBE.

From FIG. 4A and FIG. 5A, it will be seen that, in the thermal head, a part of the electrode patterns, for example the first group electrode patterns 10, is arranged at the under side of the IC chip 8. As shown in FIG. 4A, the first group electrode patterns 10 are connected through the gold wires 9 to pads 800 on the IC chip 8 at the opposite side against the heating resistors 5 side in the longitudinal direction of the IC chip 8. Instead of the first group electrode patterns 10, the second group electrode patterns 11*a* and 11*b* may be arranged under the IC chip 8.

Figures 7A, 7B, 7C, 7D, 7E, 7F, 7G:
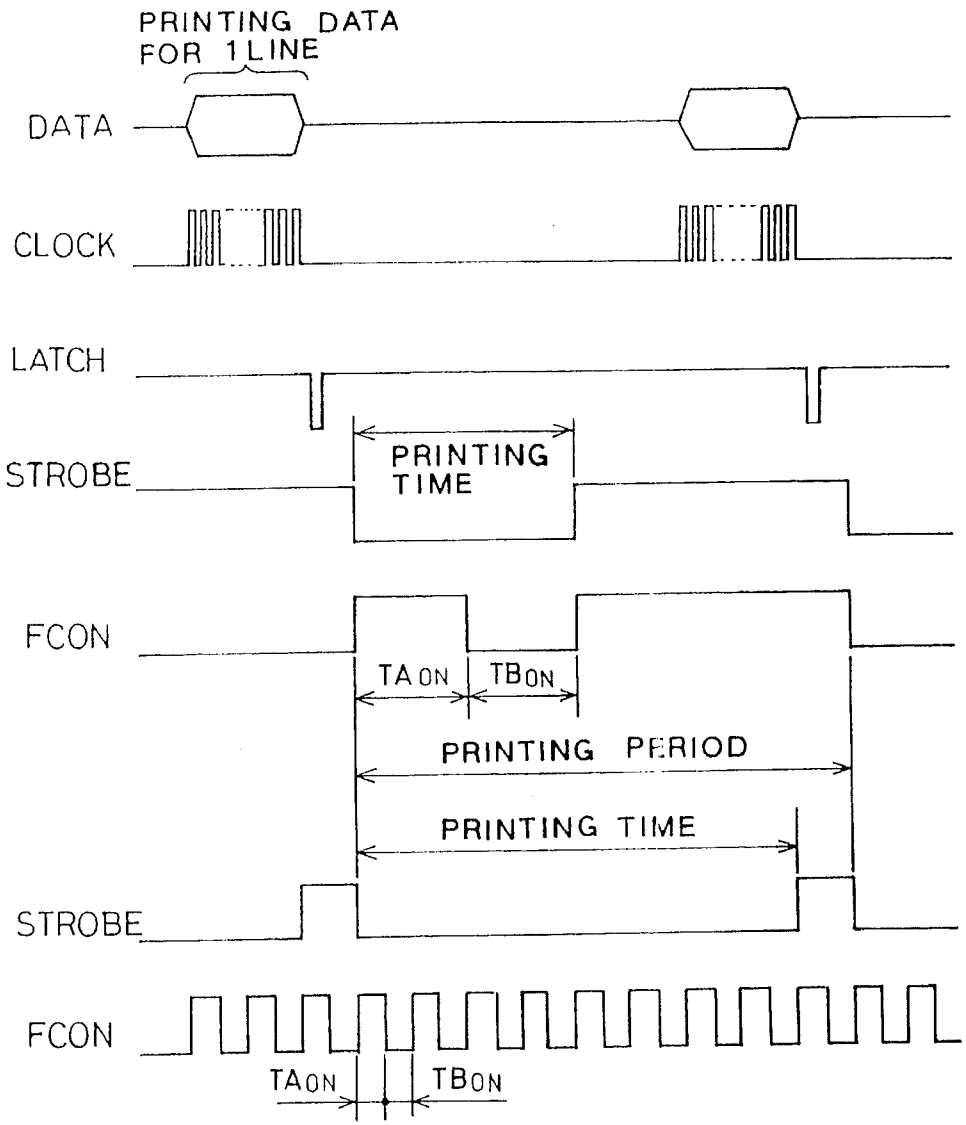
FIGS. 7A to 7G are signal timing charts of the thermal head according to an embodiment of the present invention.
Figure 8:
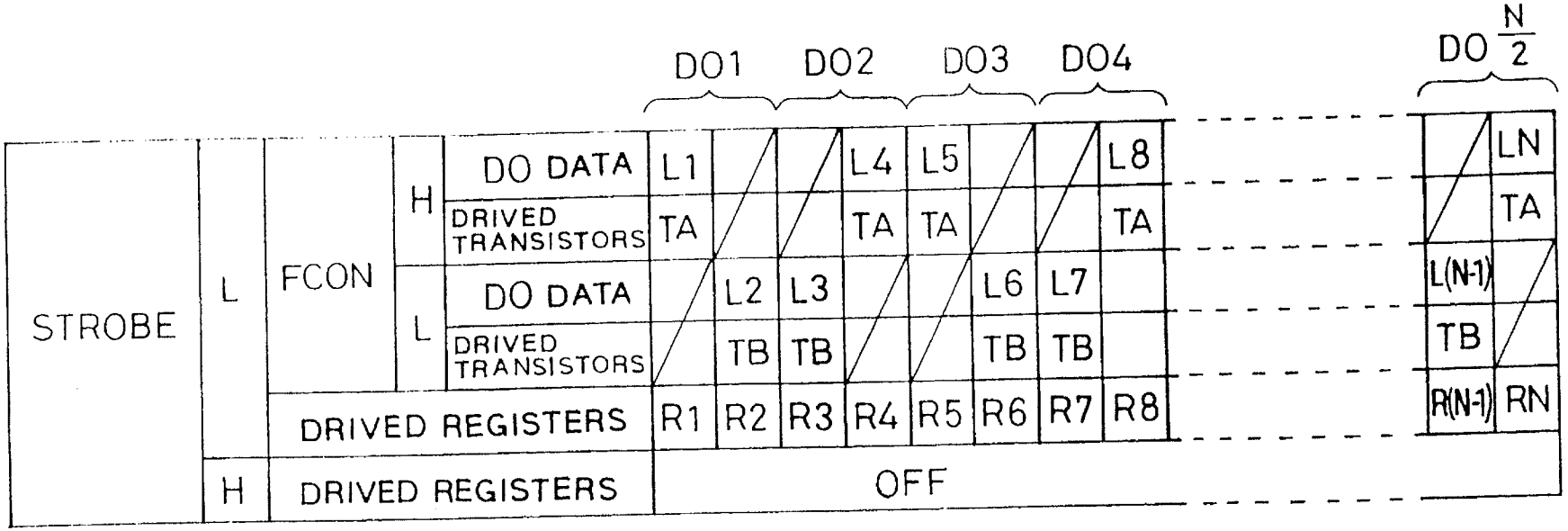
FIG. 8 is a logic diagram explaining the operation of the thermal head according to an embodiment of the present invention.

FIGS. 7A to 7G show a signal input timing chart of the circuit shown in FIG. 6, and FIG. 8 shows its logical operation.

Next, the operation will be described. The circuit shown in FIG. 6 operates as shown in the operation logic diagram shown in FIG. 8. Therefore, with respect to the N heating resistors R1 to RN, under the condition when the *STROBE is "L" and when the FCON is logic "H", the one group TA of the second group switching elements 29 are driven so that the heating resistors R1, R4 and R5, R8 and R9, . . . RN are driven. When the *STROBE is "L" and when the FCON is logic "L", the other group TB of the second group switching elements 29 are driven so that the heating resistors R2 and R3, R6 and R7, . . . R(N−2) are driven.

Figure 9A:
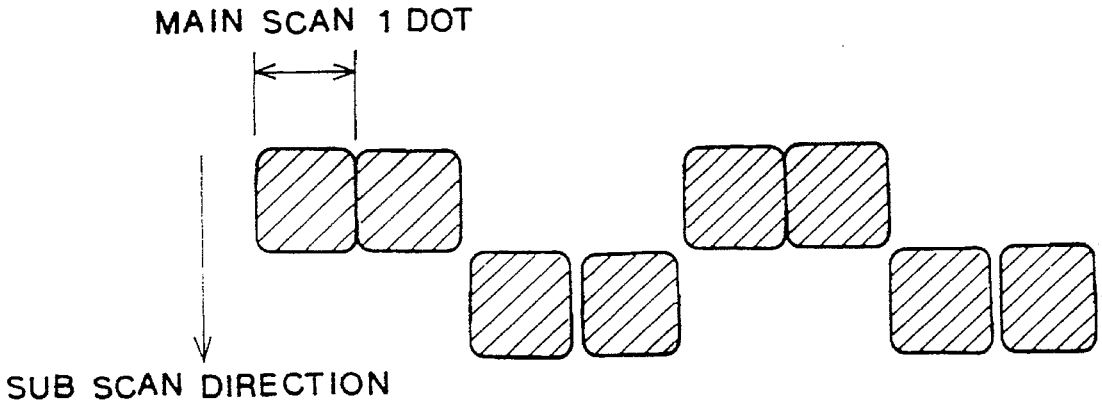
FIG. 9A is an explanation diagram showing the shape of the dots of printed characters printed by the conventional thermal head.
Figure 9B:
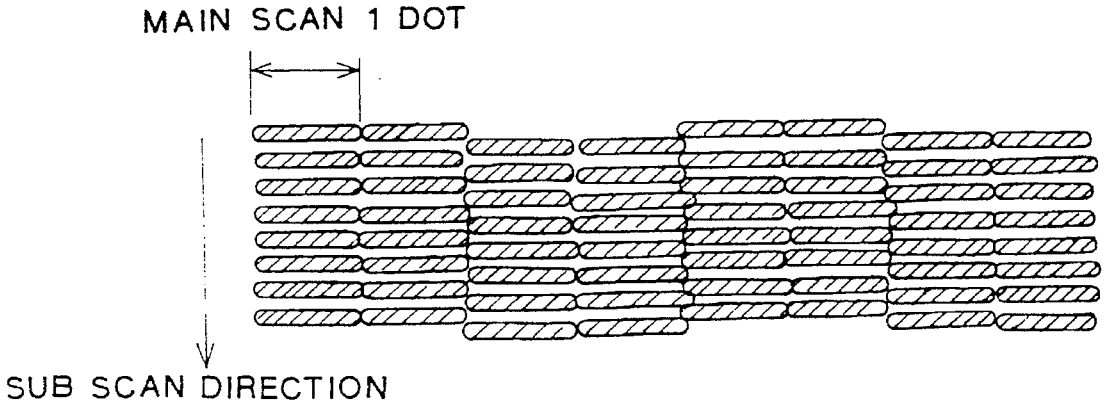
FIG. 9B is an explanation diagram showing the shape of the dots of printed characters printed by the thermal head according to an embodiment of the present invention.

These selection driving is effected by the drive of the first group switching element 26 and by the drive of the second group switching elements TA or TB, in which the conventional two lines of the diode arrays connected to the terminals C1 and C2 shown in FIG. 2 are changed to the two lines TA and TB. However, since the current to be conducted through each of the heating resistors has been made to be small by the development of technologies, the second group switching elements TA and TB can be realized by npn transistors each of which conducts a small current in comparison with the diode so that it becomes possible to switch at a high speed. The second group switching elements 26 also are, in this embodiment, npn. transistors. Accordingly, if the selecting data STROBE and FCON are the same as the conventional one as shown in FIGS. 7D and 7E, the quality of the printed image is the same as that of the prior art example (Japanese Patent Publication (Kokai) No. 59-123365) shown in FIG. 9A, however, according to the embodiment of the present invention, it becomes possible to enter the high-speed switching pulses as shown in FIGS. 7F and 7G so that, as the printing result, as shown in FIG. 9B, a quality of a picture in which the shift of the two-dots pair of the printing dots is not remarkable can be obtained.

In an experiment performed by the inventor of the present invention, it was possible without any problem to switch between the TA and TB at up to around 100 KHz (driving time period is 5 μs).

In the circuit shown in FIG. 6, the operating signals of the second group switching elements TA and TB are obtained by a logical product of the FCON and the *STROBE. This is because, even when the FCON pulse is always applied, the operation of the second group switching elements TA and TB is not effected when the logical stage of the *STROBE signal is "H" so that the circuit is operated safely.

In this embodiment, a case is described in which the number of the heating resistors is the same as the number of the stages of the shift register or the number of the storage elements, however, it may be also possible to provide the same effects by providing a circuit construction in which the number of the stages of the shift register or the number of the storage elements is larger than the number of the heating resistors so as to effect a data transfer at a higher speed, or in which a heat hysteresis control is effected easily by a data transfer.

In this embodiment, it is described that the heating resistors 5 form a strip-shaped continuous heating resistor by using a thick-film process, however, it is also possible to form a heating resistor only between electrodes by, for example, a thin-film process. Further, instead of the thermal head, another electronic parts to control passive elements such as liquid crystal elements, plasma light emitting elements, and so forth may also possible, and provides the similar effects as a circuit.

Embodiment 2

Figure 10:
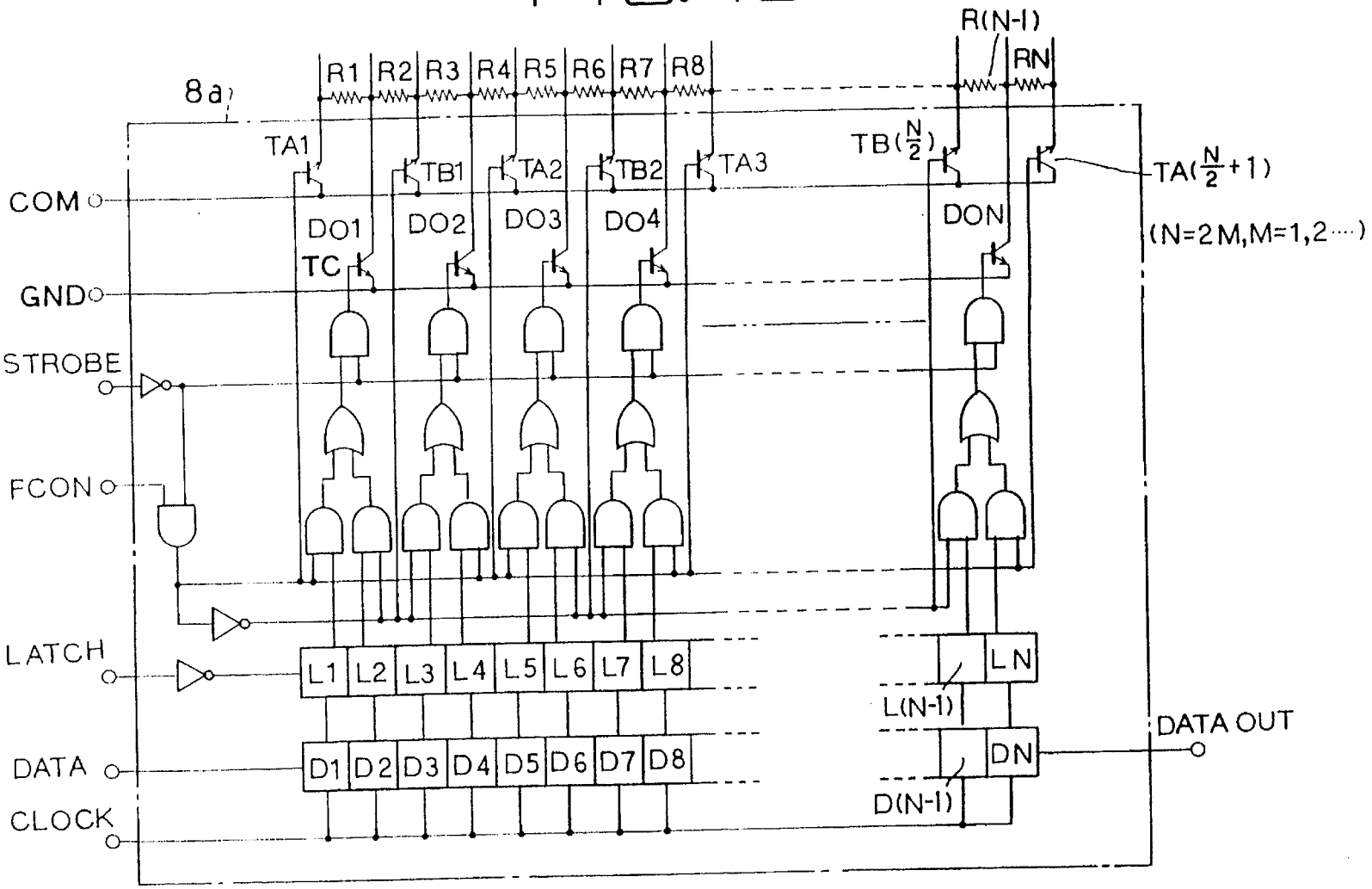
FIG. 10 is a circuit diagram of a thermal head according to another embodiment of the present invention.

In the above-mentioned embodiment 1, a half of one line data is selected and, based on the selected data, currents are flown out from the electrodes and currents are flown in into the adjacent electrodes. However, it is also possible that the directions of the flow-in and flow-out may be reversed, as shown in FIG. 10 to provide the similar effects as the above-described embodiment 1. In FIG. 10, the second group switching elements TA1 and TB1 and the first group switching elements TC are npn transistors.

Embodiment 3

Figure 11:
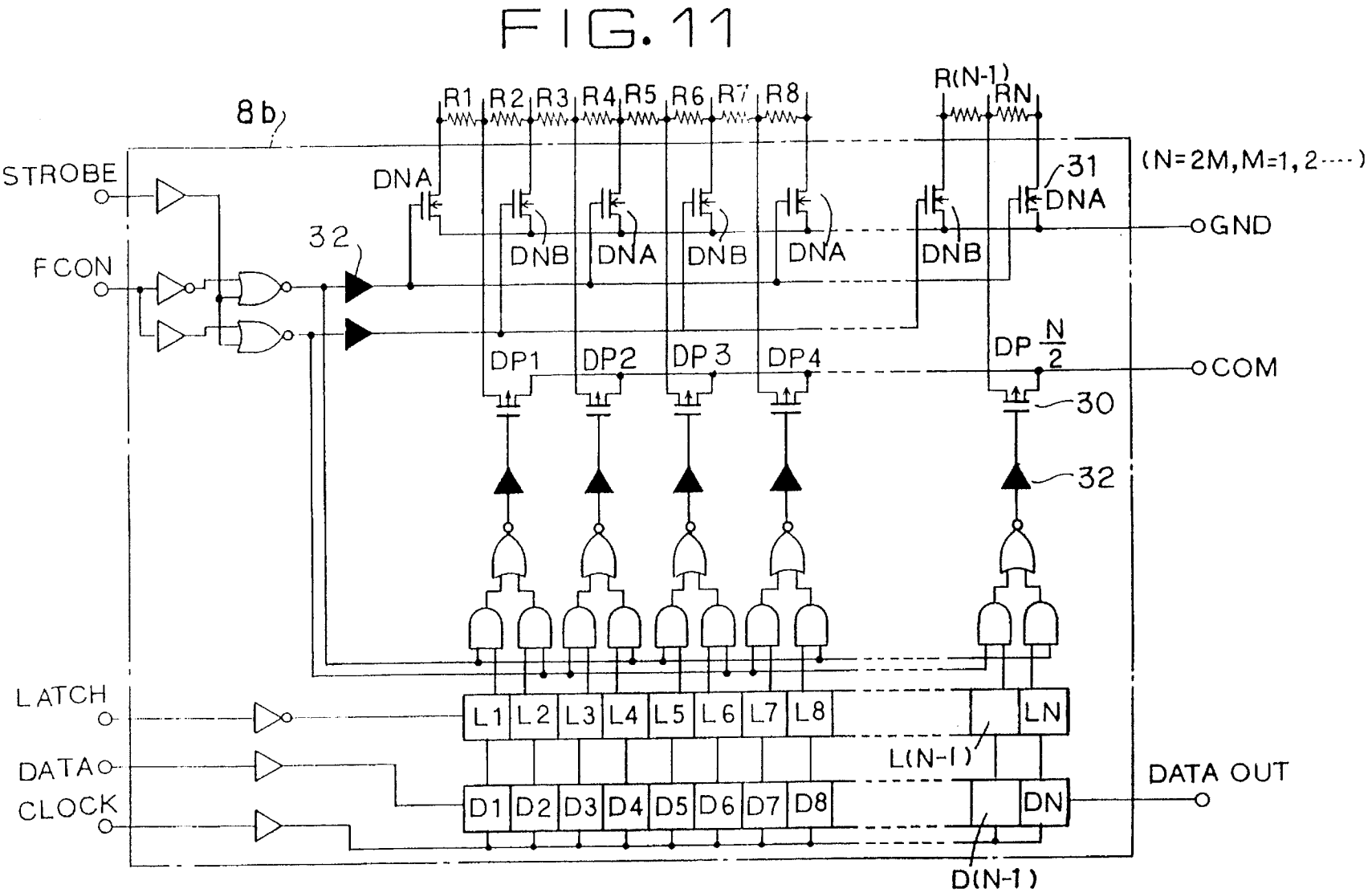
FIG. 11 is a circuit diagram of a thermal head according to still another embodiment of the present invention.

In the above-mentioned embodiments 1 and 2, the second group and flow-out switching elements are formed by transistors, however, they may be formed, as shown in FIG. 11, by P channel MOS field-effect transistors (FET) 30 and N channel MOS field-effect transistors (FET) 31 forming CMOSs and which are driven by evel-up circuits 32, whereby the size of the transistors can be miniaturized so that the IC chip 8 can be miniaturized and the assembly of the thermal head having a higher resolution becomes easy.

Embodiment 4

Figure 12B:
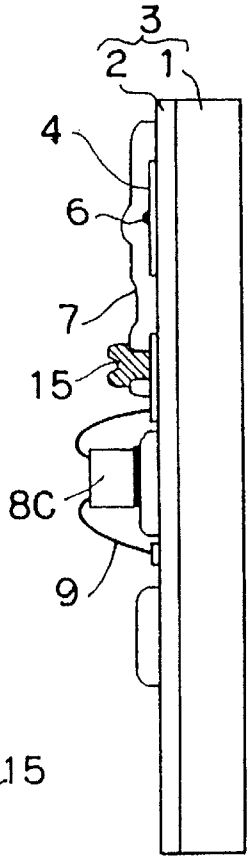
FIG. 12A and FIG. 12B are a plan view and a cross-sectional view of a thermal head substrate according to still another embodiment of the present invention.
Figure 12A:
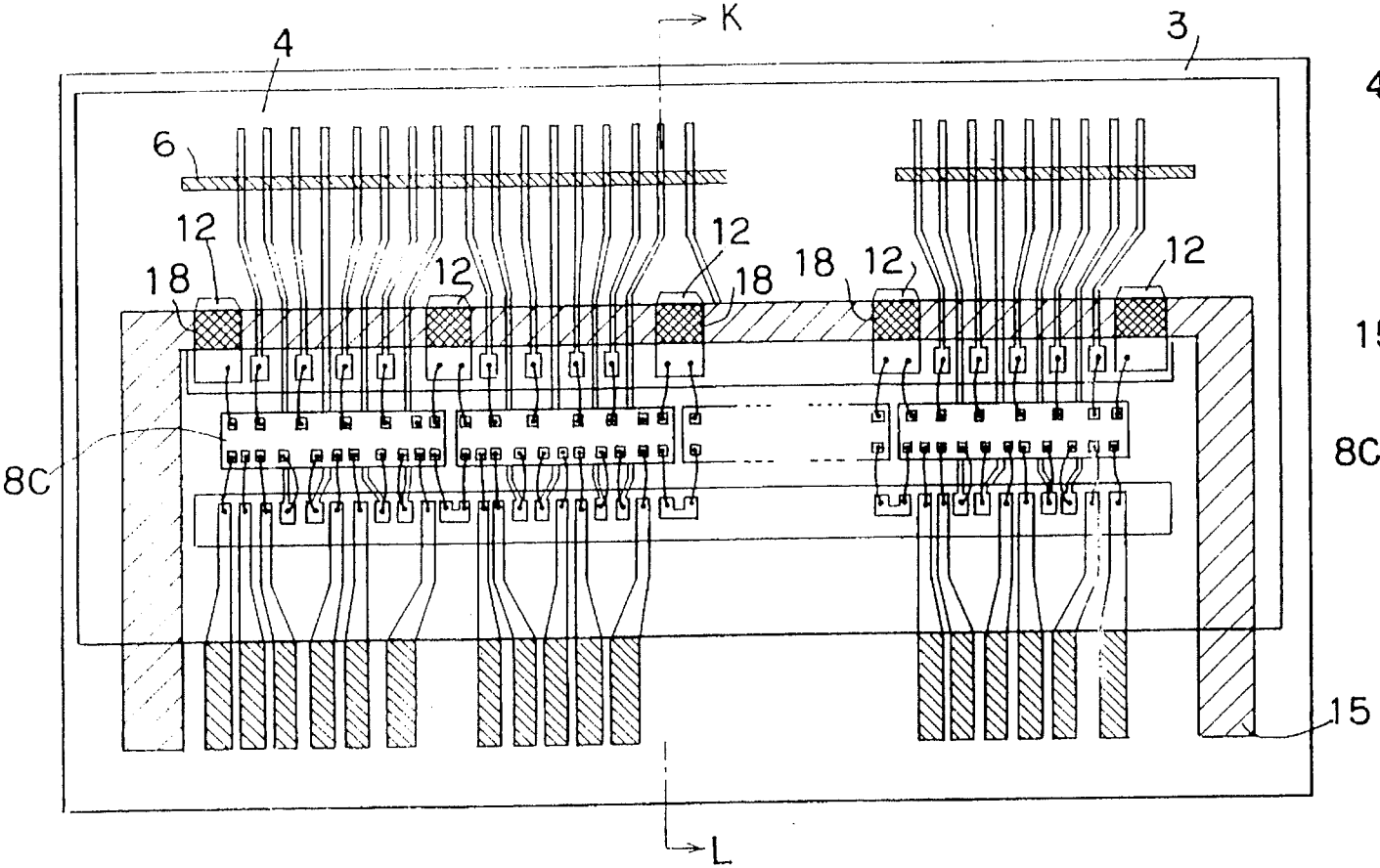

In the above-mentioned embodiment 1, the conductor 15 is arranged just under the IC chip 8, however, the conductor 15 may be arranged, as shown in FIG. 12A and 12B, at a place other than the place just under the IC chip 8. In this case, since the width of the conduction pattern 15 can be made large, an object to lower the grounding resistor of the conductor 15 can be easily attained.

It is also possible, without providing the conductor 15, to arrange the grounding terminals at the signal terminal 14 side so as to connect to external members. Also, in the manufacturing process, the resistors and the conductors may be formed by thin film forming processes instead of the thick film forming process, to provide the similar effects as in the above-described embodiments.

Figure 13B:
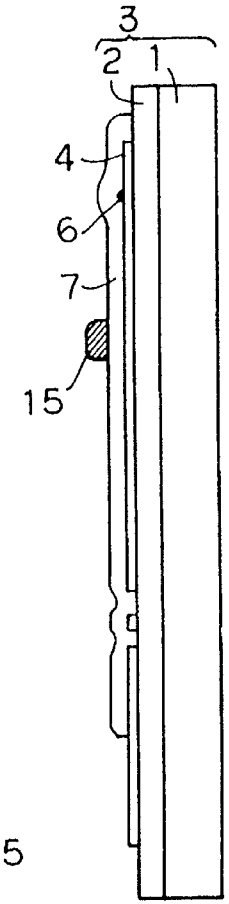
FIG. 13A and FIG. 13B are a plan view and a cross-sectional view of a thermal head substrate according to still another embodiment of the present invention.
Figure 13A:
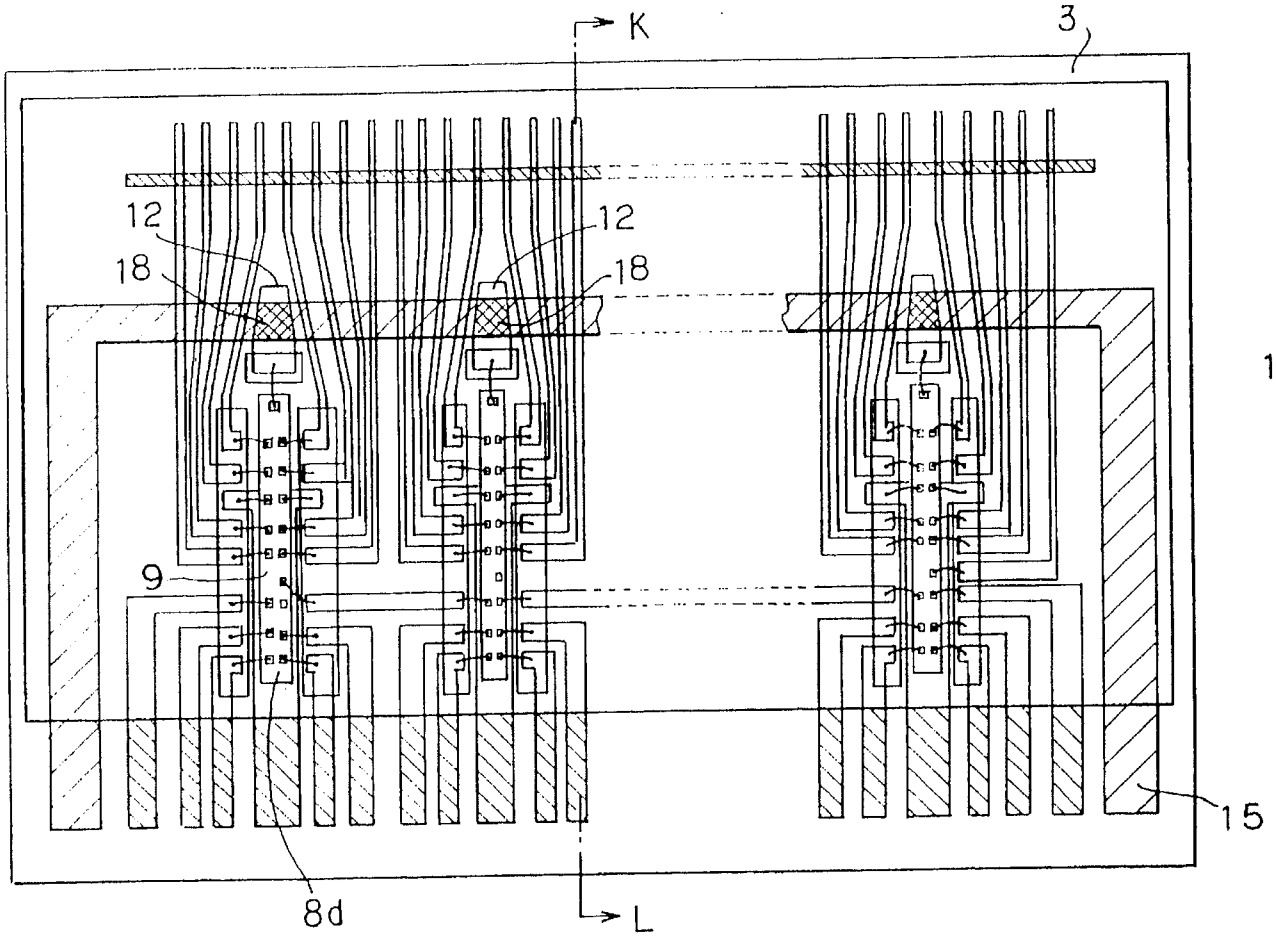

In the above-mentioned embodiments, the gold wires 9 on the IC chip 8 are extended to direct to the heating resistors 5, however, as shown in FIGS. 13A and 13B, by turning the IC chips 8 by 90°, the connecting pitch for the gold wires 9 can be made wider so that a thermal head having a higher resolution can be obtained.

Embodiment 6

Figure 14:
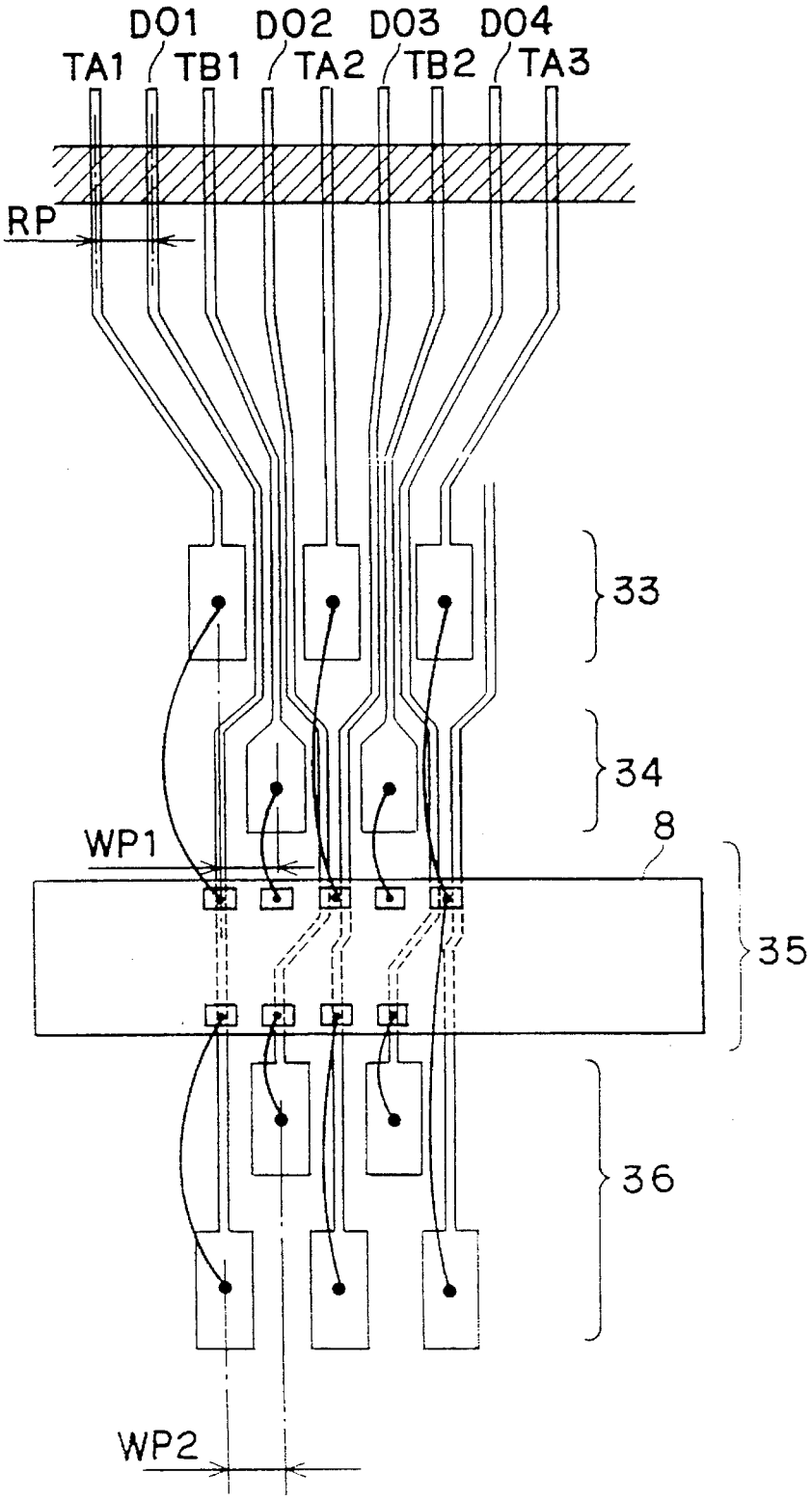
FIG. 14 is a plan view showing a pattern of a thermal head according to still another embodiment of the present invention.

In the above-mentioned embodiment 1, the connecting portions at which the IC chip 8 and the electrode patterns 10 or 11*a* and 11*b* are connected by the gold wires 9 are arranged along a line and to have the same pitch therebetween, however, as shown in FIG. 14, by making a zigzag arrangement of TA stitch patterns 33, TB stitch patterns 34, and DO stitch patterns 36 as shown in FIG. 14, the connection between the electrode patterns and the IC chip 8 by the gold wires 9 becomes easy. The larger the size WP1 of the pitch between the stitch pattern 33 and the stitch pattern 34 and the size WP2 of the pitch between the stitch patterns 36, the connection is more easy. By placing the signal electrode patterns 36 under the IC chip 8, and by connecting the stitch patterns 36 to the connecting pads on the IC chip 8 through the wires, the pitch WP2 can be made large and the stitch width can be made wide, so that the yield of the wire bonding is improved. Note that the connections between the IC chip 8 and the patterns on the substrate 3 may be made not only by the gold wires but also by soldering bump and so forth by which the connection yield is improved similarly.

Embodiment 7

In the above-mentioned embodiment 1, the adjacent second group switching elements TA and TB are simultaneously turned ON and OFF or turned OFF and ON. In this case, at the time of switching, there is a state in which both of the elements TA and TB are in the ON state so that a large current flows and the quality of the printed characters is deteriorated. To prevent this, it is desirable to have a construction in which the input signal logic of the FCON is delayed and have a construction in which the transistors TA and TB are not simultaneously driven to be ON states. This can prevent the destruction of the IC chip due to the simultaneous ON states which causes spikes at the switching time from "H" to "L" or "L" to "H" of the elements TA and TB. Further, the thermal head and the driving IC chip can be driven more stably.

Figure 15:
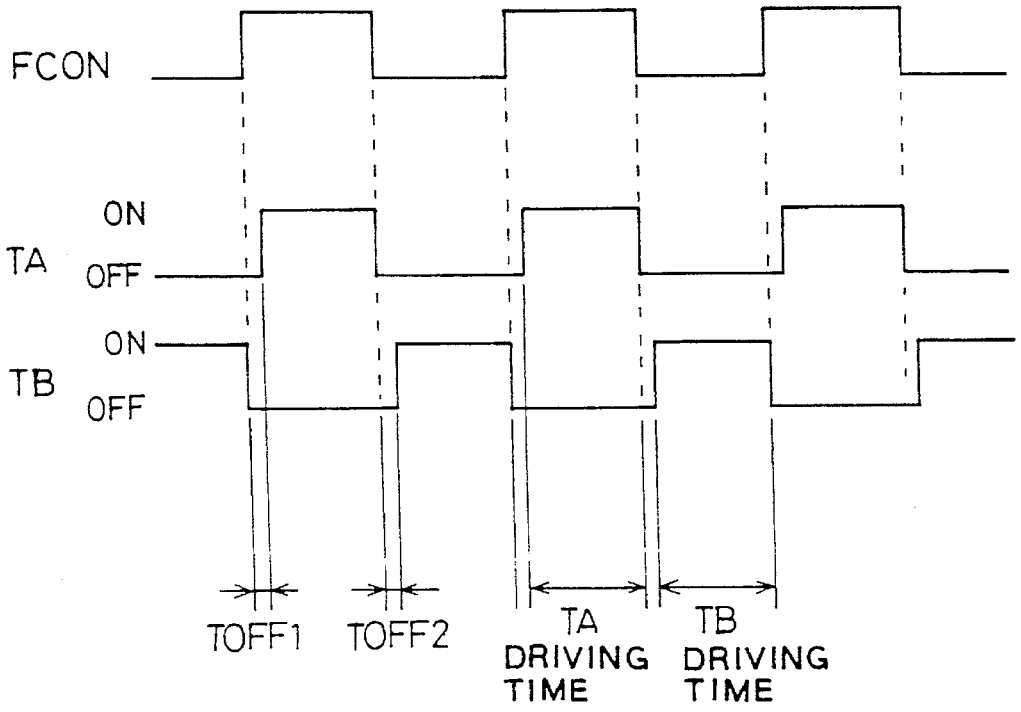
FIG. 15 is a timing chart showing a switching operation in a thermal head according to still another embodiment of the present invention.

In practice, as shown in timings shown in FIG. 15, by providing a time TOFF1 for turning OFF before turning ON of the TA and a time TOFF1 for turning OFF before turning ON of the TB, a more reliable safety operation of the circuit is ensured. In this case, the TOFF1 and the TOFF2 may be the same and may be about 3 μs, which are realized by forming a delay circuit formed by small-sized capacitors and resistors in the IC chip.

Also, the driving times of the TA and TB may be changed by changing the pulse-duty ratio of the FCON, and the pulse duty ratio may not be restricted to 50%. For example, a pulse applied to a heating resistor for a previously printed character may be longer than a pulse applied to a heating resistor for a character to be printed next time. In such a way, a control for eliminating an influence of stored heat for printing becomes possible by changing the pulse duty ratio.

Embodiment 8

Figure 17:
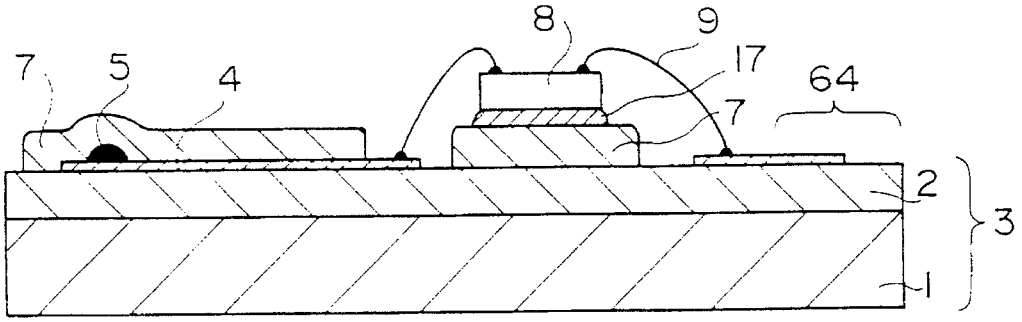
FIG. 17 is a cross-sectional view of the thermal head substrate shown in FIG. 16 according to the embodiment of the present invention.
Figure 16:
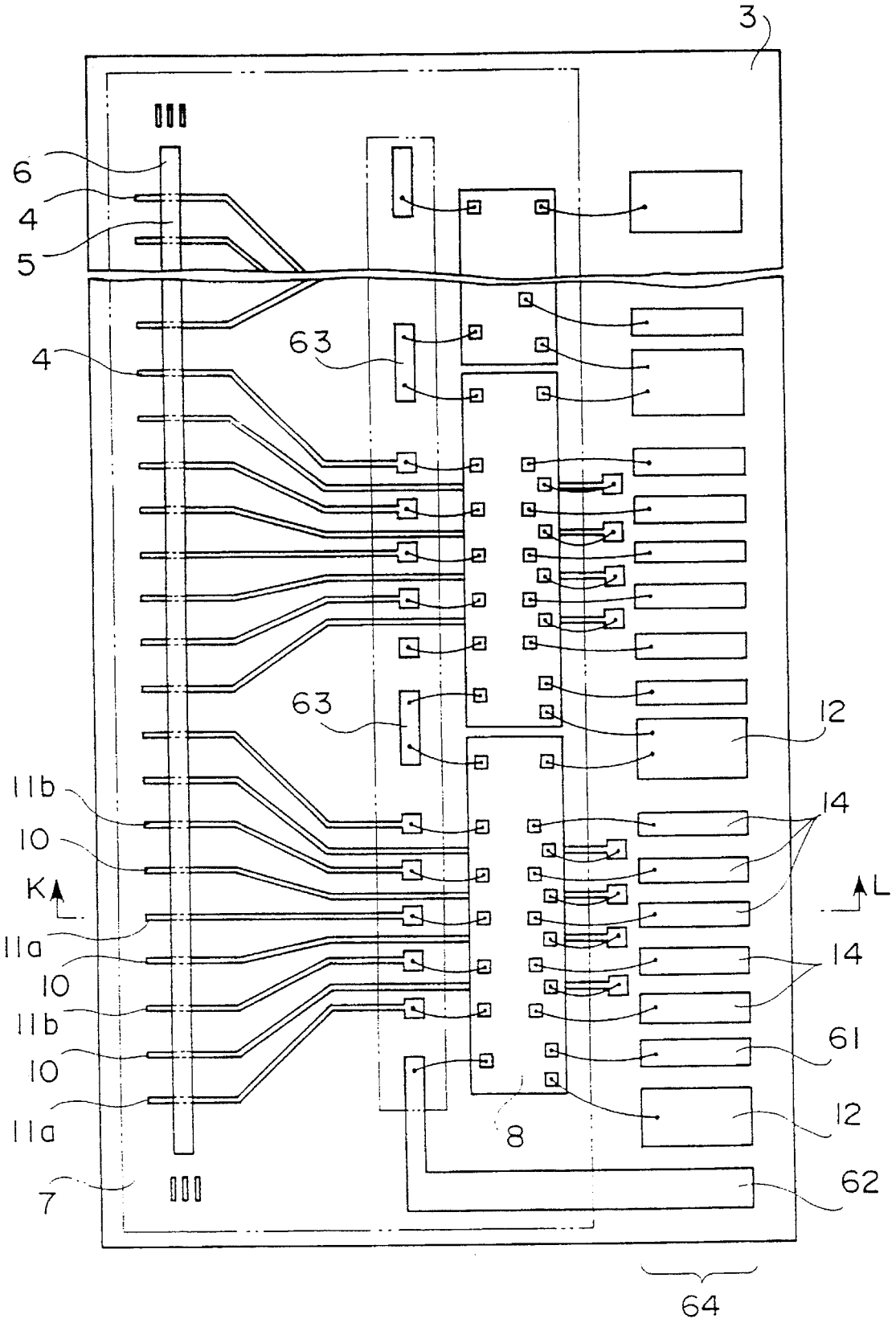
FIG. 16 is a plan view of a thermal head substrate according to still another embodiment of the present invention.

FIG. 16 is a plan view of substrate of the thermal head showing the embodiment 8 of the present invention, and FIG. 17 is a cross-sectional view along a line K-L in FIG. 16. The same parts in the afore-described embodiment with reference to FIG. 4A, FIG. 4B, and FIG. 6 are denoted by the same symbols and the double explanations are omitted. In FIG. 16 and FIG. 17, 61 is a voltage source terminal, 62 is a data input terminal for receiving data from an external world, 63 is a data connecting terminal for connecting between IC chips, and 64 represents terminals for connecting with an external member (not shown). The terminals 64 include the grounding terminals 12, the signal terminals 14, and the power supply terminal 61.

FIG. 18 is a circuit diagram of the substrate of the thermal head in the above-mentioned FIG. 16 with the same symbols for the same parts in FIG. 6, in which 65 is an IC driving power supply terminal.

As can be seen from FIG. 16 and FIG. 17, according to the embodiment 8, the connecting terminals 64 to be connected to external members are arranged in a line at the one side of the substrate 3 so that there are the effects in that the connections between the connecting terminals 64 and the external members are easy, and the grounding terminal strengthen patterns, which are necessary when the grounding terminals are provided in the central portion of the substrate as in the embodiment 1 shown in FIG. 4A, are not necessary.

Figure 19:
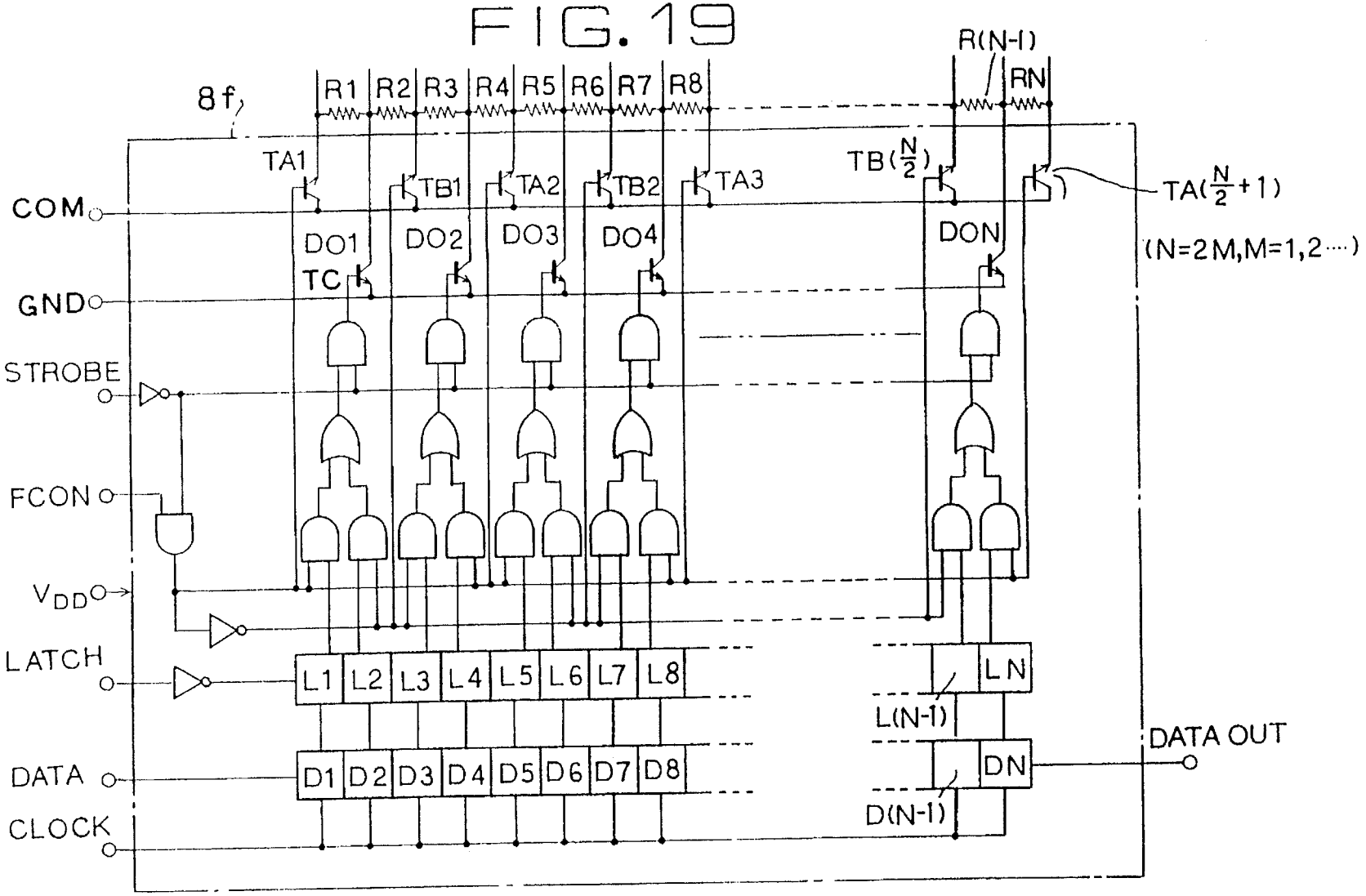
FIG. 19 is a circuit diagram of a thermal head according to still another embodiment of the present invention.
Figure 20:
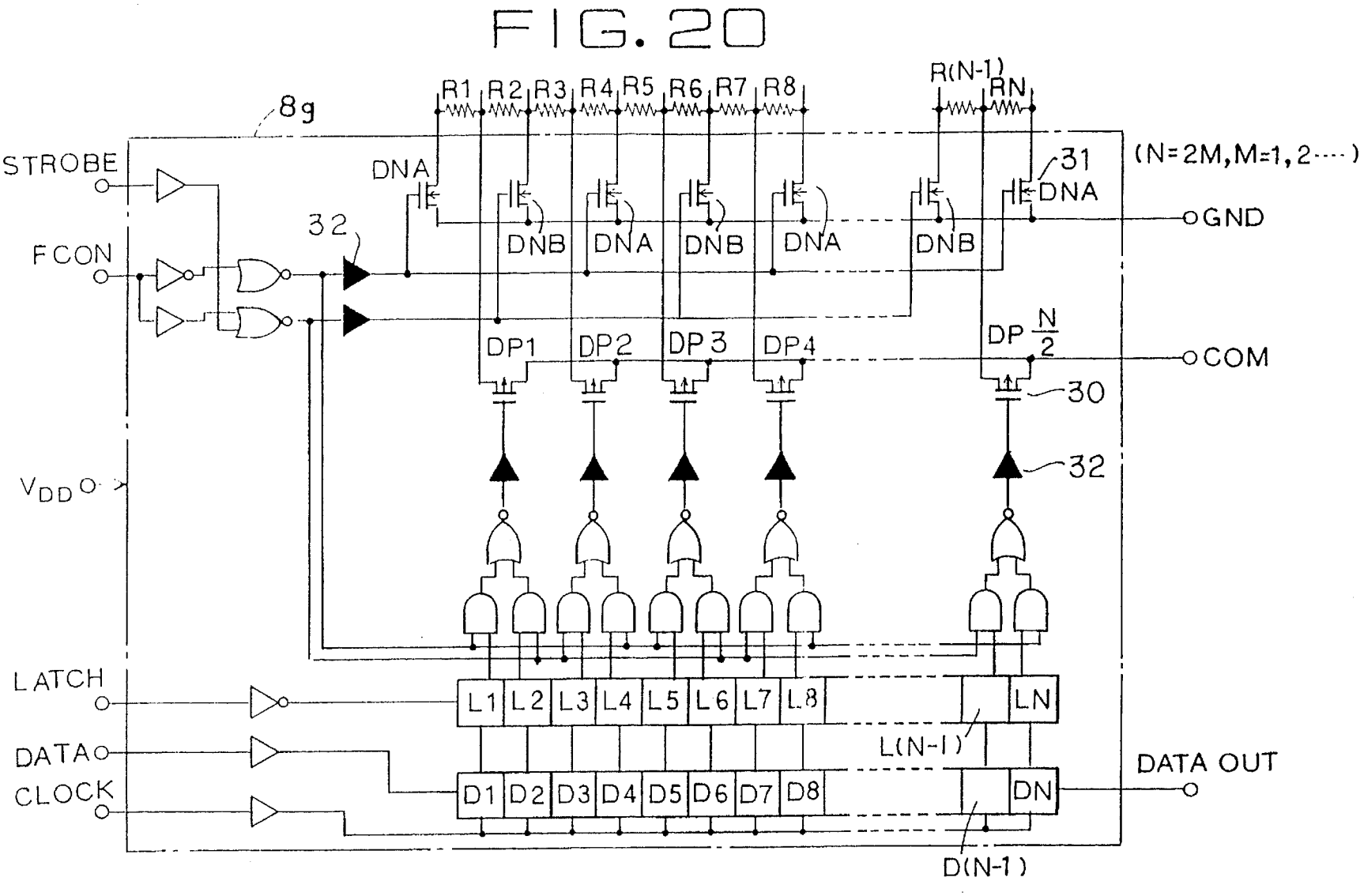
FIG. 20 is a circuit diagram of a thermal head according to still another embodiment of the present invention.

The circuit of FIG. 18 can be constructed in such a way that, as shown in FIG. 19, the direction of the current flow in or the current flow out from the electrode patterns can be reversed in the similar way as in FIG. 10 or as shown in FIG. 20, the flow-in switching elements or the flow-out switching elements can be constructed by the P channel MOS FETs 30 and the N channel MOS FETs 31 in the similar way as in FIG. 11.

Embodiment 9

In the above embodiment 1, the heating resistors 5 are covered by the protection film 7 and to convey the recording paper on the protection film 7, however, by the continuous conveyance of the recording paper using the insulating member of the relatively high resistance protecting film 7, a static electricity of several ten KV is generated under the condition of a dry and low temperature. Due to this phenomena, the heating resistors 5 of several KV of tolerance voltage, the IC chip of several hundred V of tolerance voltage, and so forth are broken.

Figure 21:
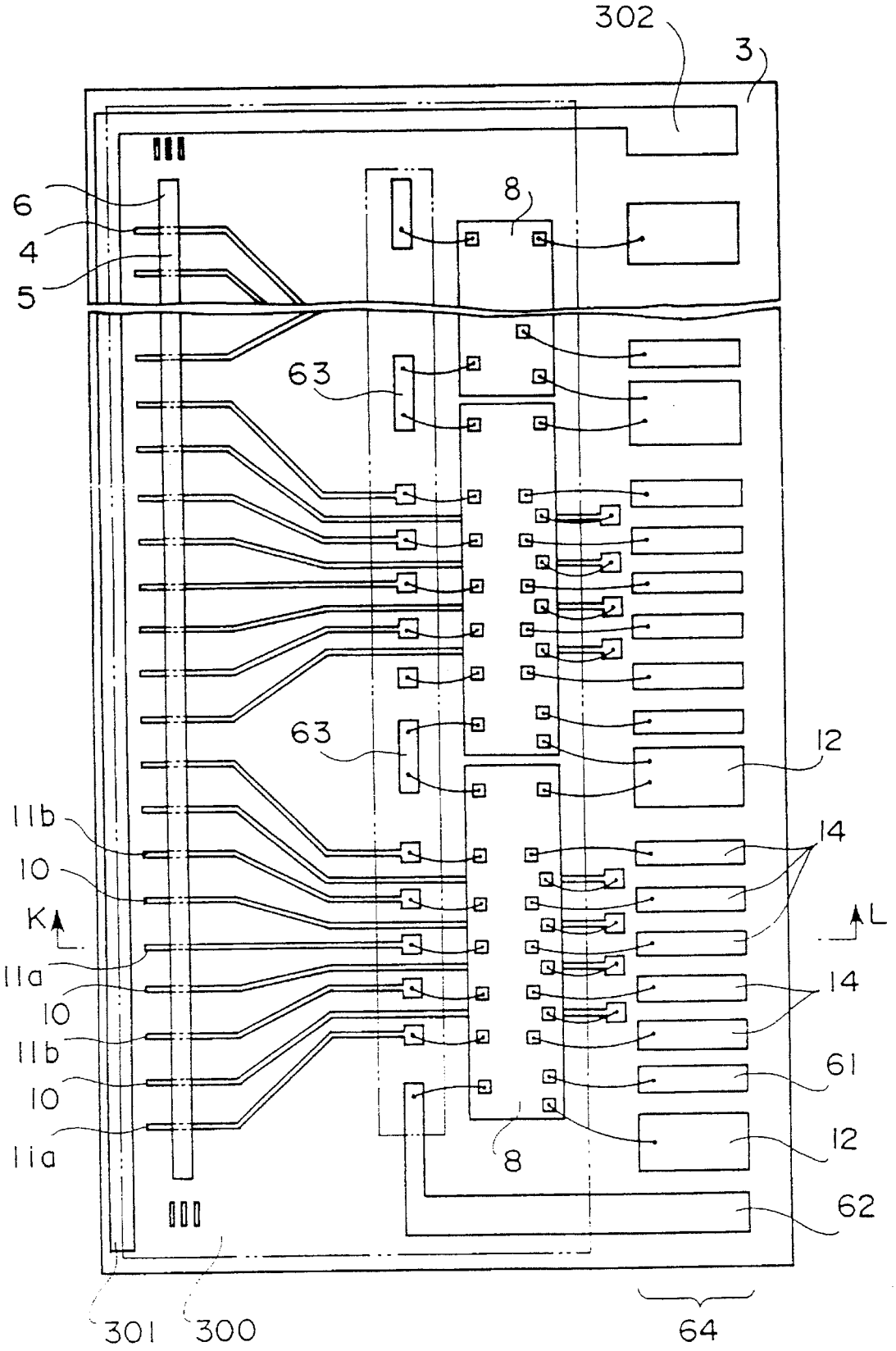
FIG. 21 is a plan view of a thermal head substrate according to still another embodiment of the present invention.
Figure 22:
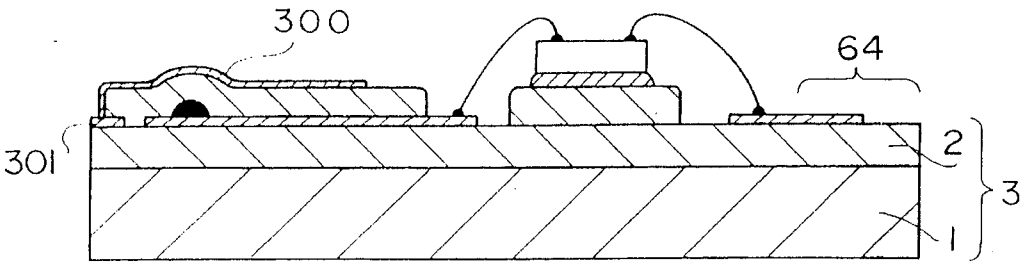
FIG. 22 is a cross-sectional view of the thermal head substrate shown in FIG. 21.

To prevent this, as shown in the plan view of the substrate of the thermal head in FIG. 21 and its cross-sectional view along the line K-L in FIG. 22, a high-resistance film 300 is provided on the protection film 7 which covers the heating resistors 5 and the electrode patterns 4, and a high-resistance film connecting pattern 301 is connected to the film 300. The connecting terminal 302 for the high resistance film is connected to, for example, the voltage source or the ground potential. Whereby, the protection film 7 is not charged so that the heating resistors 5 and the IC chip 8 are not destroyed.

As the high resistance film 300, the inventor of the present invention printed, dried, and fired a thick film resistance paste formed of indium and tin, on the protection film 7, and the thickness of the film was made to be several μm, the volume resistivity was made to be $10^6$ to $10^6$ Ω·cm. Note that, as long as the volume resistivity is around $10^6$ to $10^{10}$ Ω·cm, the material of the high resistance film is not restricted to the above but may be, for example, titanium, tungsten, and so forth.

Also, by connecting the high resistance film 300 to the voltage source potential, the decrease of the biting of the electrode patterns due to the electric field during waiting of the printing characters under the high humid condition when a pin hole is provided in the protection film 7 is improved in comparison with the case to connect the high resistance film 300 to the grounding potential so that, in this case, the countermeasure for the static electricity and the countermeasure for the biting due to the electric field are provided.

Embodiment 10

Figure 23:
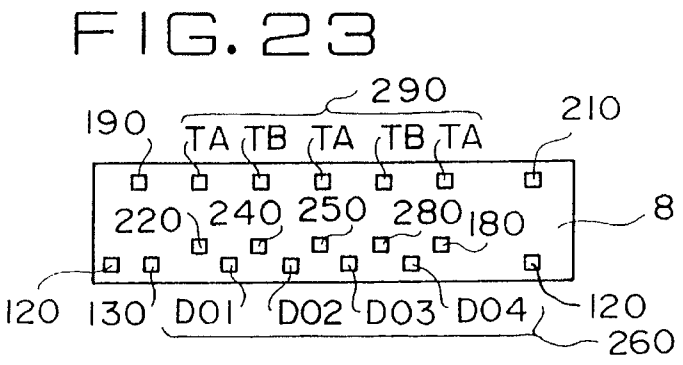
FIG. 23 is a diagram of a signal terminal arrangement of an IC chip according to the first embodiment of the present invention.

FIG. 23 schematically shows the arrangement of the signal terminals on the IC chip 8 used in the thermal head substrate shown in FIG. 4A or FIG. 16. The IC chip 8 shown in FIG. 20 is the one for controlling the eight heating resistors R1 to R8 shown in the circuit of FIG. 6. In FIG. 23, 190 is a pad as a driving data input terminal, which is connected through the wire 9 to the data input terminal for receiving data from the external world or to the data connecting terminal for connecting between IC chips, of the patterns on the substrate. 210 is a pad as the driving data output terminal, which is connected to the data connecting terminal through the wire 9. The IC chip data is connected to the previous stage IC chip, and the driving data output is connected to the driving data input of the next stage IC chip.

220 is a pad as a synchronizing input signal terminal, 240 is a pad as a data transfer control terminal, 250 is a pad as a selection timing input terminal, 280 is a pad as a switching element driving time determining signal terminal, and 180 is a pad as an IC driving power source terminal for receiving a voltage of, for example, 5 V. These pads are connected through the wires 9 to the various signal terminals 14 on the substrate.

260 represents pads to be connected to the first group switching elements, and are the outputs D01, D02, D03, and D04 of the selecting circuit 270. 130 is a pad as a voltage source input terminal COM for the current flow-out, which is connected through the wire 9 to the voltage source terminal 13 on the substrate.

290 represents pads to be connected to the second group switching elements, which are input pads of the second group transistors of the two groups TA and TB. 120 is a pad as a grounding terminal for the current flow-in, which is connected through the wire 9 to the grounding terminal 12.

By providing the pad arrangement of the IC chip 8 as shown in FIG. 23, signals of the IC chip can be drawn to the terminals 64 (FIG. 16) to be connected to the external members by only one layer of the conduction pattern on the substrate so that the manufacture of the substrate of the thermal head becomes easy. Here, even when for example 24 V is employed as the voltage of the voltage source of the thermal head, and even when for example several KΩ is employed as the resistance of the heating resistor 5, if the number of the heating resistors which are driven at the same time is large, a large current is flown through the wiring patterns so that, if there are losses in the voltage source and the ground potential due to the resistances of the wiring patterns, there is a possibility in that the respective driving voltages of the heating resistors may be different. As a result, the heating of the heating resistors may be different so that the quality of the printing characters may be deteriorated.

To avoid this, it is necessary to commonly connect the voltage source terminals 13 together to a voltage source pattern, and commonly connect the ground terminals 12 together to a grounding pattern so as to decrease the loss of the potential by the resistors in the voltage source connection and the ground connection. The value of the potential loss must be smaller than a value of, for example, 0.2 V, which does not influence on the quality of the printing characters. This is realized by determining the width and the thickness of the voltage source pattern and the ground pattern which are the wirings to the external members consisting of printed boards. Thus, by connecting the voltage source pattern and the grounding pattern having the thickness and the width determined as above to the external members, the deterioration of the quality of the printed characters can be prevented.

Figure 24:
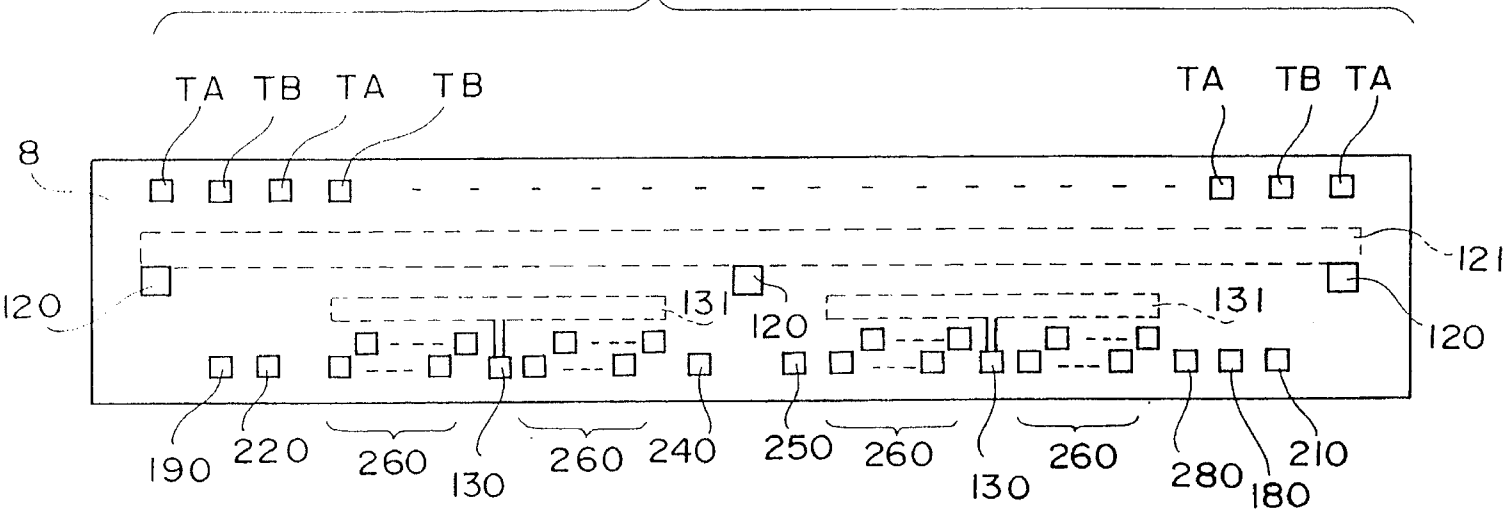
FIG. 24 is a diagram showing another signal terminal arrangement of an IC according to still another embodiment of the present invention.

In the embodiment shown in FIG. 23, the grounding pads 12 in the chip 8 are two in the longitudinal direction in the IC chip, and the voltage source pad 13 is one, however, as shown in FIG. 24, by arranging a grounding pattern (or a voltage source pattern) 121 on a center portion in the short side direction of the IC chip, and by arranging voltage source patterns (or ground patterns) 131 on an edge portion in the short side direction of the IC chip, the grounding pads 120 and the voltage source pad 130 can be easily arranged at the edge portion along the longitudinal direction of the IC chip so that, even when an IC chip has a large number of the first group switching elements and the second group switching elements, the grounding resistance and the voltage source resistance in the IC chip can be made small, and, since the connections between the pads on the IC chip and the patterns on the substrate through the gold wires 9 for example can be effected from the one side of the IC chip, the pattern connections become easy, the manufacture of the thermal head becomes easy, and the loss in the voltage source and the ground potential can be decreased.

Note that the positions of the grounding pads 120 and the voltage source pad 130 are not restricted but can be determined to arbitral positions taking into account the relation of the arrangements of the pattern resistors and the substrate patterns in the IC.

Embodiment 12

In the above-described embodiment 1, the IC chip 8 is constructed by providing the first group and the second group switching elements in the same chip, however, as shown in a thermal head substrate in FIG. 25, a first group transistor array chip (hereinafter referred to as TIC chip) 38 and a second group transistor array chip (hereinafter referred to as DIC chip) 39 may be separately constructed.

Figure 25:
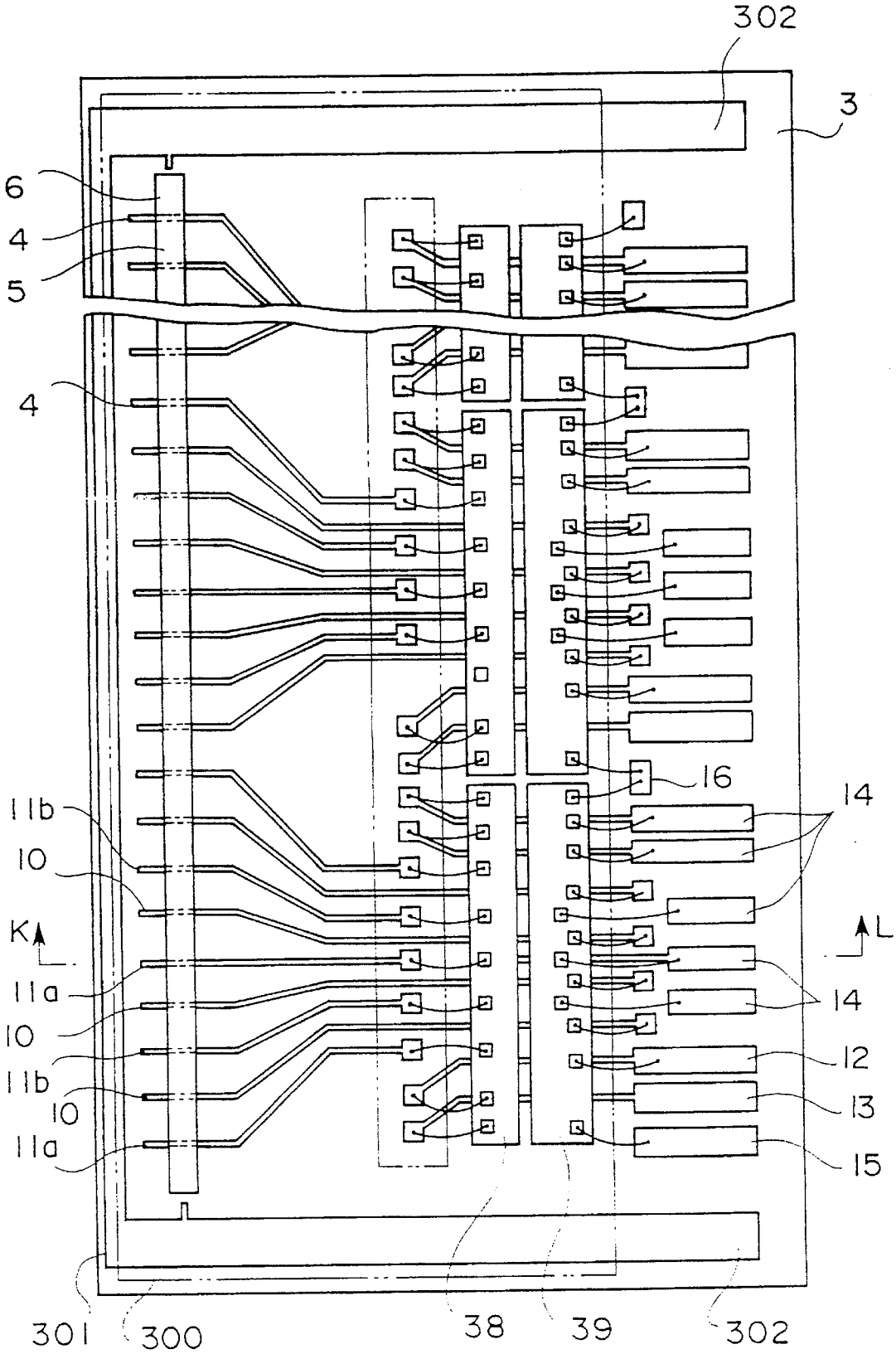
FIG. 25 is a plan view of a thermal head substrate according to still another embodiment of the present invention.
Figure 26:
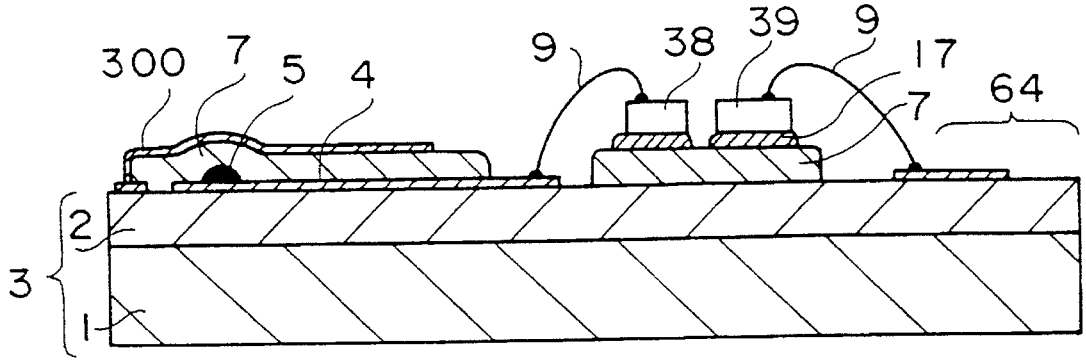
FIG. 26 is a cross-sectional view of the thermal head substrate shown in FIG. 25.
Figure 28:
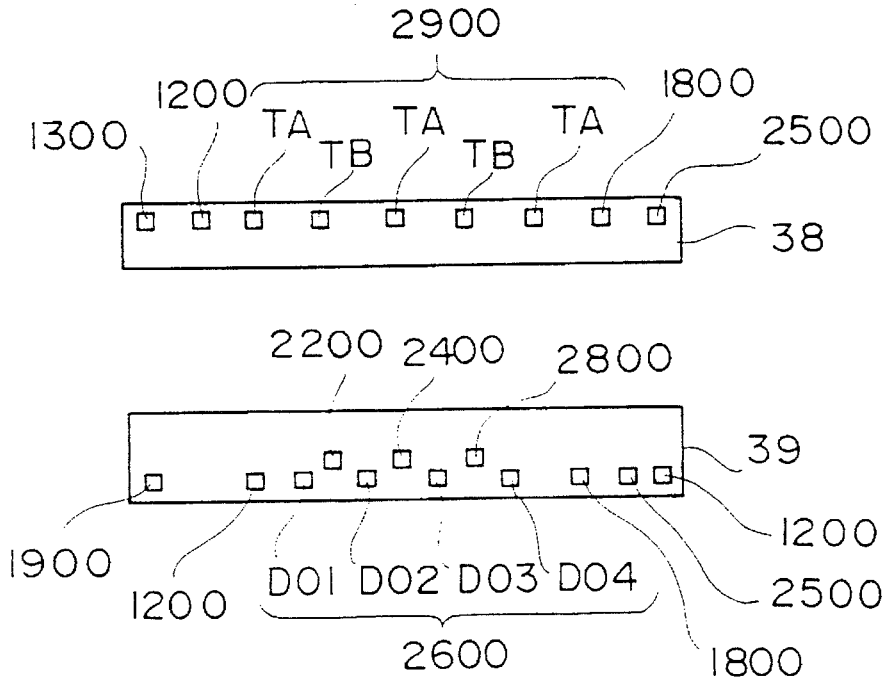
FIG. 28 is a diagram of a signal terminal arrangement of IC chips applied to the thermal head substrate shown in FIG.
Figure 27:
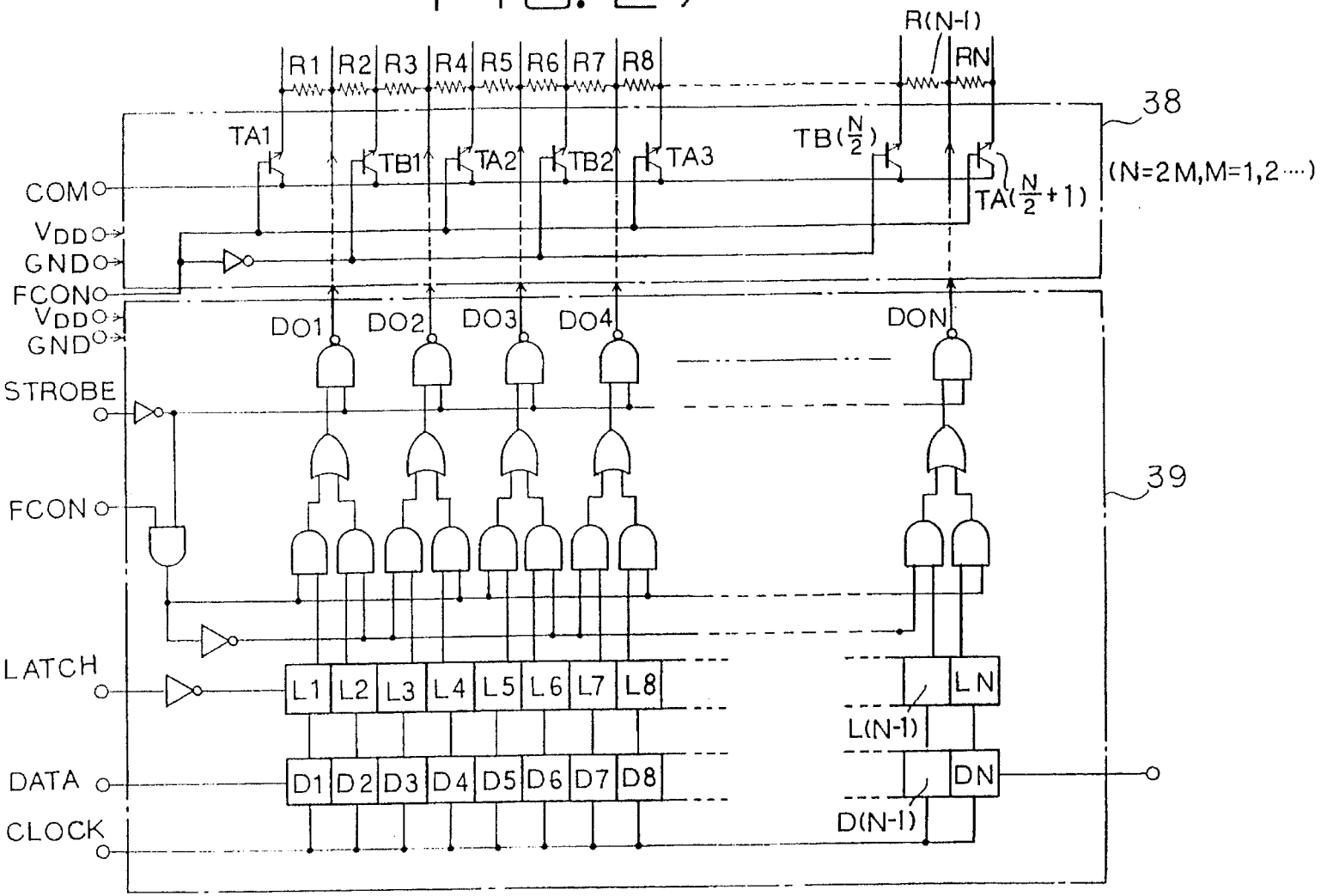
FIG. 27 is a circuit diagram of a thermal head according to still another embodiment of the present invention.

FIG. 26 shows a cross-sectional view along a line K-L in FIG. 25, FIG. 27 a circuit diagram of the thermal head substrate in FIG. 25, and FIG. 28 a schematic arrangement of the signal terminals of the TIC chip 38 and the DIC chip 39 used in the thermal head substrate in FIG. 25.

In FIG. 28, 1900, 2100, 2200, 2400, 2500, 2600, 2800, and 2900 respectively correspond to the driving data input pad 190, the driving data output pad 210, the synchronizing signal (CLOCK) input pad 220, the data transfer control signal (LATCH) input pad 240, the selecting signal (FCON) input pad 250, the pads 260 to be connected to the first group switching elements 26, and pads 290 to be connected to the second group switching elements 29. 1200 is a grounding pad, 1800 is a power source ($V_{RD}$) pad for the IC chip, and a terminal 1300 is a voltage source pad. On the TIC chip 38, the grounding pad 1200, the voltage source pad 1300, the power supply pad 1800, and the FCON input pad 2500 are arranged and are connected to the DIC chip 39, and to the grounding terminals, the voltage source terminal, and the various signals terminals which are to be connected to the external members.

By separating the chip 8 into the TIC chip 38 and the DIC chip 39, the processes to form two kinds of high tolerance voltage elements such as the first group switching elements and the second group switching elements in one IC chip are not necessary. For example, both of the N-channel MOS FETs and the P-channel MOS FETs are not necessary to be formed on one IC chip. Accordingly, one IC chip can be formed by effecting a process for forming only one channel so that the yield of the IC chip is improved and the manufacture of the thermal head becomes easy.

Embodiment 13

In the embodiment shown in FIG. 26, the direction of the wire connection between the IC chip and the patterns 64 on the substrate to be connected to the external members is directed to the side at which the external members are to be connected, however, as shown in FIG. 29 and FIG. 30, by making the direction to be opposite, with respect to the IC chip 39, to the side at which the external members are to be connected, the connection between the patterns 64 and the external members can be made easier. The difference between FIG. 30 and FIG. 31 in which an IC encapsulation resin 51 is provided in the device in FIG. 26, is that, when an external member 52 such as a flexible printed board consisting of, for example, a pattern surface 60 and a film surface 61, is to be connected to the connecting terminal by pressure by using, for example, a metal plate 63 through a pressuring rubber 62, there is a disadvantage in FIG. 31 in that the IC encapsulation resin 51 may collide with the external member 52 so that a force is applied to the gold wire 9 to cut it, and this disadvantage can be prevented by the construction shown in FIG. 30 in which the wire 9 is provided to the opposite side to the external members with respect to the IC chip 9.

Also, in the construction shown in FIG. 31, it is necessary to assemble the external member 52 and the part of the resin 51 so as not to collide with each other. By the construction shown in FIG. 30, however, even when the size for connection with the external member 52 is the same, the part of the IC encapsulation resin 51 is far from the external member 52 since the gold wire part is not present in the external side so that they do not tend to collide. Note that, in FIG. 29 to FIG. 31, an explanation was given for two IC chips, however, as a matter of course, the case in which only one IC chip is provided is also possible. Also, the positions of the IC chips may be different from the illustrated arrangement of the TIC chip 38 and the DIC chip 39.

Embodiment 14

In the above-described embodiment 1, the electrode patterns are comb-shaped type, and the strip-shaped heating resistor is arranged on the comb-shaped electrode patterns as shown in FIG. 32, however, in a thick-film thermal head, to adjust the resistance of the heating resistors, a method called as a trimming disclosed in U.S. Pat. No. 4,782,202 is used to be able to adjust the resistances of the respective heating resistors.

In FIG. 32, 400 to 404 represent the electrode pattern pads. The resistance of each resistor is determined by the distance between the electrode pads 400 and 401, 401 and 402, 402 and 403, or 403 and 404. By applying high voltages to the electrode patterns, the initial resistances of the heating resistors are lowered to desired resistances to adjust the resistances of all resistors.

Here, in a thick film thermal head for facsimile machine of 16 dots/mm for example, the width RL of the heating resistor 5 is 120 μm and the distance between the electrode patterns is about 30 μm, however, as shown by arrows in FIG. 33, the lowest resistance parts obtained by the pulse trimming vary widely. As a result, the heating points vary depending on the respective resistors so that the quality of the printed characters becomes bad. This is because the width RL of the heating resistor is wider than the distance between the electrode patterns, however, at the present situation, the heating resistor is formed by a screen printing method and the width is close to the width formed by the limit value for the electric field so that it is difficult to form a resistance film having a width shorter than the above width RL.

Also, when the main scanning is 16 dots/mm, the sufficient size of the color-generating dot size in the sub-scanning direction may be 62.5 μm, however, at the present situation, the size of the formed heating resistor is made to be larger than the size of the color-generation dot size. This is because, if the formed size of the heating resistor is smaller, there will be a problem in that the applied energy for obtaining a desired color generation size will exceed the tolerance energy of the heating resistor.

To solve these problems, the inventor of the present invention considered to make the lowest resistances of the heating resistors to be uniform by expanding the center of each electrode pattern as shown in FIG. 34 and performed various experiments.

FIG. 35 shows the sizes of the heating resistors which were subject for the experiments, in which the characterizing features of this embodiment lie on sizes LG, G, and RC. FIG. 36 and FIG. 37 show examples of the experiments showing the sizes in the various experiments, in which the experiment No. 1 is the case of the shape of the electrode pattern shown in FIG. 33. In the figures, RC represents a difference between the center of the projected portions of the electrode patterns and the center of the width of the resistor of the heating resistors.

FIG. 36 shows the effects of the distance G between the electrode patterns for the experiments No. 2, 3, and 4, and FIG. 37 shows an influence of the difference RC of the centers for the experiments No. 6, 7, and 8.

FIG. 38 is a diagram of characteristics of the average concentration of the printed characters according to the experimental sizes in FIG. 36, in which the averages of measured 10 points are shown. FIG. 39 is a diagram of characteristics showing the variations of the concentrations of the printed characters by plotting the lowest values, the average values, and the maximum values of the measured 10 points of concentrations at the applied energy of 0.5 E in FIG. 38.

FIG. 40 shows the experimental results of the tolerance energy when the resistances are changed after applying a pulse of $1\times10^6$ and with an increase of the energy. As the condition of the applied energy, the printing period was 2.5 ms and the applied energy $E_0$ was $E_0$=0.08 mJ/dot. Also, as the recording paper, a thermal paper F230AA made by Mitsubishi Seishi was used. From the results of these experiments, it has been found that, by narrowing the interval between the central portions of the electrode patterns on the heating resistors, the characteristic of the concentration of the printed characters becomes linear and the variation of the concentrations of the printed characters becomes small. From the results of the experiments, it has been found that, according to the experiment No. 2, the tolerance energy is not lowered so much, the characteristic of the concentration of the printed characters becomes linear so that the high performance of gradation can be obtained easily and the variation of the concentration of the printed characters can be made small.

Also, from the characteristic diagram of the average concentration of the printed characters shown in FIG. 41 based on the experimental sizes in FIG. 37, when the difference between the centers of the electrode patterns and the heating resistor is more than 30 μm as in the experiment Nos. 7 and 8, the concentration characteristic is lowered but a certain level of allowable value of the difference is present. In conclusion, it is better that the width RL of the heating resistor is wider and the RP is small.

These values are changed depending on the etching accuracy, the accuracy of the position of the resistors, and the sensitivity of the recording paper. The shape of the electrode is not restricted to the hexagon as shown in FIG. 34, but may be the shape of a rhombus as shown in FIG. 42 or a round as shown in FIG. 43.

Also, in the above-described embodiments, the strip shaped heating resistor 5 is placed on the electrode patterns, however, the heating resistor may be placed under the electrode patterns. Further, the electrode patterns may be embedded in the thick film of the heating resistor. Any way, it is sufficient to form a resistor between the electrodes.

Still further, in the above-described embodiments, the strip shaped heating resistor 5 is placed on a plane of the substrate, however, as shown in FIG. 44 the strip-shaped heating resistor 5 may be placed on the edge surface portion of the substrate. In this case, a picture immediately after the printing can be seen. In addition, since the structure is such that the edge surface portion of the substrate is pressed in the vertical direction against the recording paper carrying system of the thermal head using apparatus, the recording paper carrying system is made simple.

Further, when it is used for a thermal copy, an ink ribbon for the thermal copy and a recording paper (copied paper side) are carried simultaneously, and then the ink ribbon for the thermal copy is taken off. In this case, the taking off of the ink ribbon is effected at a portion near the heating resistor at the edge surface portion of the substrate so that the quality of the printed characters is improved.

Embodiment 16

Next, a manufacturing method of the thermal head relating to the present invention will be described with reference to FIG. 45 and FIG. 46. The used substrate 3 is, for example, a glass glaze substrate 2 formed by an alumina-ceramics substrate 1 having an edge with a curvature and a thickness of about 2 mm, the total surface of which is coated by glass paste. After soaking the substrate 3 into, for example, a solution of organic gold paste, it is drawn up, dried, and fired to form an organic gold film 71 having a thickness of, for example, 0.5 μm.

Next, it is soaked in a photo-sensitive resist solution, and then it is drawn up and dried to form a photosensitive resist layer 72 having a thickness of about several μm. On the substrate with the photo-sensitive resist layer 72 formed as above, a mask 70 with electrode patterns is covered. From the upper side thereof, light is exposed to form an electrode pattern image on the photo-sensitive resist layer 72. Then, based on the electrode pattern image, the organic gold film 71 is etched to complete the organic gold patterns. The patterns of the above-mentioned mask 70 are formed by, for example, chromium 73. Here, since the electrode patterns are arranged with the same intervals and having the same width, even when the masking exposure is effected from the upper surface, the patterning on the photo-sensitive resist layer 72 up to the edge surface portion is possible as long as the thickness of the substrate is about 2 mm.

Next, the substrate 3 on which the electrode patterns are formed is stood in the vertical direction, and resistance paste formed of, for example, ruthenium oxide, glass flit, and so forth is coated from a nozzle 74 to form the heating resistor, which is then dried and fired to form the desired heating resistor 5. The protection film 7 on the heating resistor is formed by coating the similar glass paste coating or by printing, and by drying and firing.

In the above embodiments, an explanation was given for the case in which the conduction film, the resistors, and the protection film are formed by thick film forming processes, however, they may be, for example, a conduction film formed by sputtering of AL, a conduction film formed by evaporation, a resistance film of $TaSiO_2$, a protection film formed by sputtering of $SiO_2$,and a protection film formed by a CVD process using $Si_3N_4$, or may be formed by a mixture of a thick film process and a thin film process. Any way, it is sufficient that electrode pattern with the equivalent intervals is formed up to the edge surface of the substrate.

Also, as the substrate 3, it is also possible to use a substrate having a slope near the edge surface, and a resistor may be formed on the slope. In this case, the manufacture of the thermal head becomes easier than the edge surface type.

Embodiment 17

In the above-described embodiments, an explanation was given for the case in which the glaze layer at the lower layer of the heating resistor forming part was plane, however, as shown in FIG. 47, it is also possible that a projection part 41 is formed in the glaze layer under the heating resistor; a stripe-shaped heating resistor is arranged on the portion around the center of the projection part 41; and the interval between electrode patterns at the center of the lower portion of the heating resistor may be made to be narrow. In this case, the heating point of the heating resistor is concentrated at the narrowed portion, and the contacting pressure with the recording paper is large, so that a good quality of the picture can be obtained even when a printing of a character by thermal copy is effected on normal paper having a bad flatness such as a paper made by Xerox.

To form the glaze projecting part 41, the inventor of the present invention formed the glaze layer having a thickness of about 50 μm on the whole surface of a ceramics substrate to form the substrate 3, covered it with a dry film, carried out a phototype process on the substrate except for a part of about 1 mm width near the heating resistor 5 and the IC chip mounted portion so as to remove the dry film, then carried out a sand blast processing from the upper surface by using, as a mask, a dry film formed by Sic grains each having a diameter of about #200 to cut out about 30 μm of the glaze layer from the upper surface. After this cutting off, an ultrasonic washing was carried out to remove cut grains and so forth. Then, the washed substrate was put into a firing furnace of about 950° C. so that the substrate with the glaze layer as shown in FIG. 48 was formed.

In the above-described embodiment, an explanation was given for the processing of the glaze layer, however, it is also possible to form the projection portion as a processing for forming the glaze layer after processing of the ceramics substrate. It is also possible to use a processing of wet etching by using nitric acid fluoride.

Embodiment 18

FIG. 48 shows the thermal head constructed by using the thermal head substrate shown in FIG. 4A which is applied to a heat sensitive recording apparatus. In FIG. 48, 50 is a thermal head substrate, 51 protecting resin formed by, for example, silicon resin, which covers the IC chip 8 and the wire 9 on the thermal head substrate 50, 52 an external member consisting of a printed board on both surfaces of which are formed with patterns, the external member 52 being fixedly connected to a connector 53, a chip part 54, and so forth by soldering. Also, the thermal head substrate 50 and the external member 52 are electrically connected through, for example, the gold wire 9.

56 is a supporting bed or holding the external member 52 and so forth. The thermal head substrate 50 and the external member 52 are fixed on the supporting bed 56 by, for example, a both-side adhesive tape.

57 is a cover for covering the protection resin 9, and also is a carrying guide for a recording paper 58. 59 is a platen roller for carrying the recording paper 58 to the place on the protection film 7 on the heating resistor 5. By the pushing pressure from the back surface of the supporting bed 56 and the rotation of the platen roller 59, characters are continuously printed on the recording paper 58 by the heat from the heating resistor 5.

Embodiment 19

In the above-described embodiment, when the driving signal FCON for selecting an switching element is applied from a external world, there may arise a problem of EMI from a signal cable and of mixing of noises with the signal, when a high frequency signal of, for example, 100 KHz is used. Therefore, to prevent this, as shown in FIG. 48 for example, an oscillating circuit chip 54 as an oscillating circuit for generating the FCON may be soldered on the printed board 52. Also, an IC chip in which an oscillating circuit is formed may be connected by wire bonding and so forth.

Embodiment 20

Figure 50A:
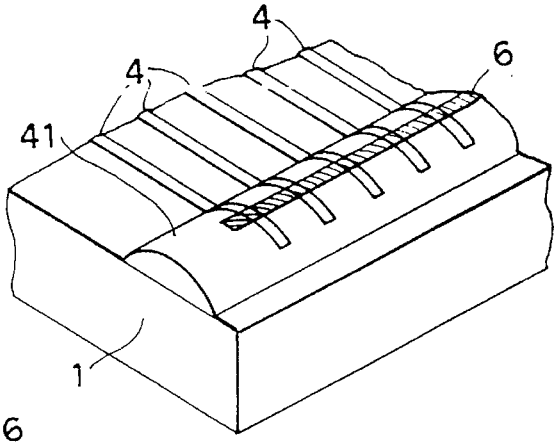
Figure 50B:
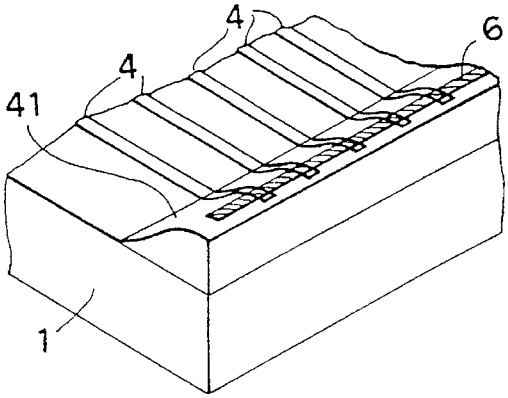
Figure 50C:
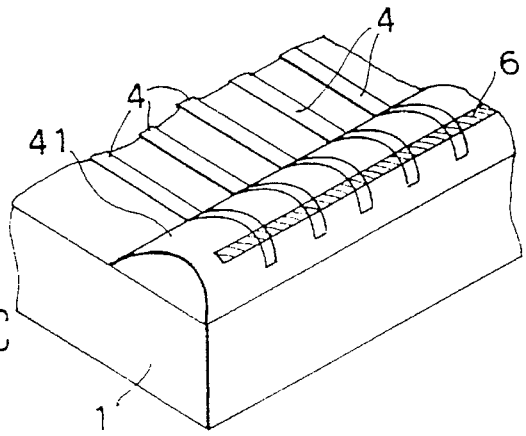

In a thermal transfer recording apparatus such as shown in FIG. 49 to which the thermal head of the present invention provided with the heating resistor at the edge portion of the substrate is applied, when an ink ribbon 37 and an image receiving paper 38 are sandwiched between the thermal head 39 and the platen roller 40 to carry it and print characters, when the position at which the ink ribbon 37 and the image receiving paper 38 are separated is closer to the heating resistor 5, the quality of the printed characters is better. Therefore, as shown in FIGS. 50A, 50B, and 50C, when a partial glaze layer 41 is provided on which the heating resistor is formed, a more improved quality of the printed characters can be obtained.

As described above, in the electronic parts according to the first aspect of the present invention, since the passive elements are arranged on an edge portion of a substrate, an electronic effect derived from the passive elements can be immediately seen by users.

In addition, since the selecting circuit selects one group or the other group of the second group switching elements, and substantially simultaneously selects at least one of the first group switching elements, the diode array is not necessary so that the switching can be effected with a small current. Therefore, the switching speed can be increased.

In the thermal head according to the second aspect of the present invention, since the heating resistors are arranged on an edge portion of a substrate, a printed image immediately after printed by the heating resistors can be immediately seen by users.

In addition, since the selecting circuit selects one group or the other group of switching elements, and substantially simultaneously selects at least one of the second group of switching elements, the diode array is not necessary so that the switching can be effected with a small current. Therefore, the switching speed can be increased.

According to the third aspect of the present invention, since the grounding pattern is arranged around the central portion of the IC chip and the voltage source pattern is arranged around the edge portion of the IC chip, the pads can be located along the one longitudinal side of the IC chip so that the external members can be connected through the pads to the voltage source pattern and to the grounding pattern with the shortest distance so that the power loss can be decreased.

According to the fourth aspect of the present invention, since the heating resistors are formed around the end surface of the substrate, an manufacturing method of the thermal head is provided by which an image immediately after printing can be immediately seen.

According to the fifth aspect of the present invention, since the above-mentioned thermal held is employed, a heat sensitive recording apparatus which can provide a printed image of an improved quality and which can make it possible to immediately see the printed image immediately after printing.

Further, since one group of electrode patterns connected to the heating resistors are arranged under the IC chip, and are connected to a pattern on the substrate at the opposite side against the heating resistor side in the longitudinal direction of the IC chip, in addition to the above effects, there is an effect of being able to make it easier of a higher density connection.

According to still further aspect of the present invention, since the voltage source terminals for the first group switching elements and the grounding terminals for the second group switching elements are connected to external members, the yield of the IC chip is improved and the manufacture of the thermal head becomes easy.

According to still further aspect of the present invention, since the thermal head comprises a first IC chip including the shift register, the storage elements, the selecting circuit, and the first group switching elements, and a second IC chip including the second group switching elements, the yield of the IC chips is improved and the manufacture of the thermal head becomes easy.

According to still further aspect of the present invention, since the direction of the wire connected between the IC chip and the patterns on the substrate is not directed to the connecting surface side to the external members, so that the connection with the external members becomes easy.

According to still further aspect of the present invention, since the thermal head comprises an oscillating circuit or an oscillating circuit chip for generating a selection signal for selecting the switching elements, the reliability of the safety operation is improved.

According to still further aspect of the present invention, a high-resistance film connected to an arbitral potential is arranged on a protection film for covering the heating resistors and the electrodes, so that the destruction of the heating resistors due to static electricity can be prevented.

According to still further aspect of the present invention, the interval between the electrodes at a position on which the heating resistor is arranged is made narrow so that the heat is concentrated at the narrowed portion of the interval between the electrodes, resulting in an improvement of the heat sensitive efficiency.

According to still further aspect of the present invention, the heating resistors are arranged between the electrodes at the edge surface, so that, when it is applied to a heat sensitive recording apparatus, a picture immediately after recording can be seen easily and the recording paper carrying system can be made simple.

According to still further aspect of the present invention, the heating resistor is arranged on the projection portion on the upper surface of the substrate, so that the contacting pressure with the recording paper is made large, resulting in a good recording.

According to still further aspect of the present invention, a grounding pattern (or a voltage source pattern) is arranged on a central portion in the direction of the short side of an IC, and a voltage source pattern(or a grounding pattern) is arranged at the edge portion of the short side of said IC chip, so that the pattern connection becomes easy and the loss in the voltage source and the ground potential can be decreased.

According to still further aspect of the present invention, adjacent two heating resistors are driven as a unit, and a delay operation is effected with respect to an input signal, whereby the simultaneous ON state due to the switching of the input signal from H to L and from L to H can be eliminated so that a stable operation can be realized.

According to still further aspect of the present invention, according to the manufacturing method of the present invention, the heating resistor can be formed at the edge surface of the substrate.

According to still further aspect of the present invention, since a thermal head provided with a heating resistor at the edge portion of a substrate is applied, a heat sensitive recording apparatus in which the quality of the picture can be improved and a picture immediately after recording can be immediately seen.

According to still further aspect of the present invention, since the heating resistor is provided on the projection portion at the edge portion of the substrate, a heat sensitive recording apparatus in which the contacting with the recording paper in which the contacting pressure with the recording paper is large so that a good recording can be carried out can be obtained.

In conclusion, in a thermal head according to the present invention, a large current and high speed switching elements and a diode array become unnecessary so that there is an effect in that the quality of the picture can be improved. Further, since the heating resistor is formed at the edge portion of the substrate, there is an effect in that an image picture immediately after printed is not disturbed by another element so that the image picture immediately after printed can be immediately seen.

What is claimed is:

1. Electronic parts comprising:

a plurality of passive elements connected in series and arranged on an edge portion of a substrate;

a plurality of electrode patterns arranged on said substrate in such a way that every adjacent two of said electrode patterns are connected across each of said passive elements, said electrode patterns being grouped into a first group electrode patterns and a second group electrode patterns, and in said every adjacent two of said electrode patterns, one being one of said first group electrode patterns and the other being one of said second group electrode patterns;

first group switching elements respectively connected to said first group electrode patterns;

second group switching elements respectively connected to said second group electrode patterns;

said second group switching elements including first and second group every other switching elements, each of said first and second group every other switching elements being connected respectively to alternate ones of said second group electrode patterns;

a selecting circuit, connected to said first group switching elements and said second group switching elements, for selecting, in response to selecting data inputted to said selecting circuit, one group or the other group of every other switching elements in said second group switching elements, and for selecting at least one of said first group switching elements, the selected switching elements being driven substantially simultaneously, whereby at least one of said passive elements corresponding to said selected switching elements are driven.

2. Electronic parts as claimed in claim 1, wherein said first group electrode patterns and said second group electrode patterns are connected to first and second group electrodes, respectively, and are alternately arranged on said substrate in such a way that adjacent two of said first group electrodes and said second group electrodes are connected across one of said passive elements;

each of said first group switching elements having an input terminal connected to a power supply terminal, an output terminal connected to one of said first group electrode patterns, and a control terminal;

each of said second group switching elements having an input terminal connected to one of said second group electrode patterns, an output terminal connected to a grounding terminal, and a control terminal; and said selecting circuit is connected to the control terminal of each of said first group switching elements and the control terminal of each of said second group switching elements, for selecting, in response to selecting data inputted to said selecting circuit, either one of said two groups of every other switching elements in said second group switching elements, and for selecting at least one of said first group switching elements.

3. Electronic parts as claimed in claim 1, further comprising:

a shift register, for storing a part of said selecting data for selecting at least one of said passive elements to be driven;

storage elements for latching the data output from said shift register; and a selecting signal input means for receiving and connecting to each of said first group switching elements and said second group switching elements a selecting signal for selecting one group or the other group of every other switching elements in said second group switching elements.

4. Electronic parts as claimed in claim 3, wherein said selecting circuit selects at least one of adjacent two of said first group switching elements, said adjacent two being a selecting unit, the selected first group switching elements being adjacent to one of said second group switching elements.

5. Electronic parts as claimed in claim 3, wherein said first group switching elements, said second group switching elements, said selecting circuit, said shift register, and said storage elements are formed on an IC chip.

6. A thermal head comprising:

a plurality of heating resistors connected in series and arranged on an edge portion of a substrate:

a plurality of electrode patterns arranged on said substrate in such a way that every adjacent two of said electrode patterns are connected across each of said heating resistors, said electrode patterns being grouped into a first group electrode patterns and a second group electrode patterns, and in every adjacent two of said electrode patterns, one being one of said first group electrode patterns and the other being one of said second group electrode patterns;

first group switching elements respectively connected to said first group electrode patterns;

second group switching elements respectively connected to said second group electrode patterns;

said second group switching elements including first and second group every other switching elements, each of said first and second group every other switching elements being connected respectively to alternate ones of said second group electrode patterns;

a selecting circuit, connected to said first group switching elements and said second group switching elements, for selecting, in response to selecting data inputted to said selecting circuit, one group or the other group of every other switching elements in said second group switching elements, and for selecting at least one of said first group switching elements, the selected switching elements being driven substantially simultaneously, whereby at least one of said heating resistors corresponding to said selected switching elements are driven.

7. A thermal head as claimed in claim 6, wherein said first group electrode patterns and said second group electrode patterns are connected to first and second group electrodes, respectively, and are alternately arranged on said substrate in such a way that adjacent two of said first group electrodes and said second group electrodes are connected across one of said heating resistors;

each of said first group switching elements having an input terminal connected to a power supply terminal, an output terminal connected to one of said first group electrode patterns, and a control terminal;

each of said second group switching elements having an input terminal connected to one of said second group electrode patterns, an output terminal connected to a grounding terminal, and a control terminal; and said selecting circuit is connected to the control terminal of each of said first group switching elements and the control terminal of each of said second group switching elements, for selecting, in response to selecting data inputted to said selecting circuit, either one of said two groups of every other switching elements in said second group switching elements, and for selecting at least one of said first group switching elements.

8. A thermal head as claimed in claim 6, further comprising:

a shift register, for storing a part of said selecting data for selecting at least one of said heating resistors to be driven;

storage elements for latching the data output from said shift register; and a selecting signal input means for receiving and connecting to each of said first group switching elements and said second group switching elements a selecting signal for selecting one group or the other group of every other switching elements in said second group switching elements.

9. A thermal head as claimed in claim 8, wherein said first group switching elements, said second group switching elements, said selecting circuit, said shift register, and said storage elements are formed on an IC chip.

10. Electronic parts as claimed in claim 9, wherein said IC chip is rectangular in shape having a longitudinal direction extending along the longer dimension thereof and either of said first group electrode patterns and said second group electrode patterns are arranged under said IC chip, and are connected to pads on said IC chip at the opposite side thereof from the side on which said heating resistors are connected and along the longitudinal direction of said IC chip.

11. A thermal head as claimed in claim 8 further comprising:

a driving data input terminal, connected to said shift register, for receiving driving data for driving said heating resistors;

a synchronizing signal input terminal, connected to said shift register, for receiving a synchronizing signal, said driving data being input into said shift register in response to said synchronizing signal;

a data transfer control terminal, connected to said storage elements, for receiving a data transfer control signal to transfer the driving data from said shift register to said storage elements; and a driving time determining signal input terminal, connected to said selecting circuit, for receiving a driving time determining signal for determining the driving time of the selected one or more of said first group switching elements and the selected group in said second group switching elements, said selecting signal and said driving time determining signal forming said selecting data;

said selecting circuit having a logic circuit for determining the switching elements to be driven and the driving time thereof based on a logic of said driving data, said selecting signal, and said driving time determining signal.

12. A thermal head as claimed in claim 6, wherein said selecting circuit selects at least one of adjacent two of said first group switching elements, said adjacent two being a selecting unit, the selected first group switching elements being adjacent to one of said second group switching elements.

13. A thermal head as claimed in claim 6, wherein ends of said first group electrode patterns and ends of said second group electrode patterns are arranged at end side of said substrate, said end side being close to external members to be connected to said first and second group electrode patterns.

14. A thermal head as claimed in claim 9, wherein the direction of the wire connection between pads on said IC chip and patterns on an substrate is opposite to said end side close to the external members.

15. A thermal head as claimed in claim 6, wherein the interval between said electrode patterns at a position on which said heating resistors are arranged is made narrow in comparison with the interval between said electrode patterns at other portion thereof.

16. A thermal head as claimed in claim 6, wherein said electrode patterns are extended up to the portion around the edge surface of the substrate, and said heating resistors are arranged between the electrode patterns around an edge surface.

17. A thermal head as claimed in claim 6, wherein said heating resistors are formed as a strip, and a projection portion is provided on a surface of the substrate, the strip shaped heating resistors being arranged around a top portion of the projection portion.

18. A heat sensitive recording apparatus comprising a thermal head and a platen roller for carrying a recording paper through said thermal head, said thermal head comprising:

a plurality of heating resistors connected in series and arranged on an edge portion of a substrate:

a plurality of electrode patterns arranged on said substrate in such a way that every adjacent two of said electrode patterns are connected across each of said heating resistors, said electrode patterns being grouped into a first group electrode patterns and a second group electrode patterns, and in said every adjacent two of said electrode patterns, one being one of said first group electrode patterns and the other being one of said second group electrode patterns;

first group switching elements respectively connected to said first group electrode patterns;

second group switching elements respectively connected to said second group electrode patterns;

said second group switching elements including first and second group every other switching elements, each of said first and second group every other switching elements being connected respectively to alternate ones of said second group electrode patterns;

a selecting circuit, connected to said first group switching elements and said second group switching elements, for selecting, in response to selecting data inputted to said selecting circuit, one group or the other group of every other switching elements in said second group switching elements, and for selecting at least one of said first group switching elements, the selected switching elements being driven substantially simultaneously, whereby at least one of said heating resistors corresponding to said selected switching elements are driven.

19. A heat sensitive recording apparatus as claimed in claim 18, wherein said heating resistors are formed as a strip, and a projection portion is provided on surface of the substrate, the strip shaped heating resistors being arranged around a top portion of the projection portion.

* * * * *